US007362321B2

(12) United States Patent
Kumada et al.

(10) Patent No.: US 7,362,321 B2
(45) Date of Patent: Apr. 22, 2008

(54) METHOD OF DRIVING IMAGE DISPLAY, DRIVING DEVICE FOR IMAGE DISPLAY, AND IMAGE DISPLAY

(75) Inventors: Kouji Kumada, Tenri (JP); Takashige Ohta, Yamatokoriyama (JP); Haruhito Kagawa, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 539 days.

(21) Appl. No.: 10/357,453

(22) Filed: Feb. 4, 2003

(65) Prior Publication Data

US 2003/0160775 A1 Aug. 28, 2003

(30) Foreign Application Priority Data

Feb. 25, 2002 (JP) ..... 2002-048566

(51) Int. Cl.
*G09G 5/00* (2006.01)

(52) U.S. Cl. ..... 345/209; 345/208

(58) Field of Classification Search ..... 345/204, 345/691–3, 98, 100, 94–5, 95, 96, 209, 208, 345/690

See application file for complete search history.

(56) References Cited

U.S. PATENT DOCUMENTS

| | | | | |
|---|---|---|---|---|
| 5,852,425 | A | 12/1998 | Bird et al. | 345/92 |
| 5,864,327 | A * | 1/1999 | Kokuhata et al. | 345/90 |
| 6,201,522 | B1 * | 3/2001 | Erhart et al. | 345/211 |
| 6,246,385 | B1 * | 6/2001 | Kinoshita et al. | 345/87 |
| 6,573,878 | B1 * | 6/2003 | Mizobata | 345/60 |
| 6,741,238 | B2 * | 5/2004 | Choi | 345/211 |
| 6,801,177 | B2 * | 10/2004 | Kudo et al. | 345/89 |
| 6,864,327 | B2 * | 3/2005 | Bentley et al. | 525/409 |
| 2001/0026260 | A1 * | 10/2001 | Yoneda et al. | |
| 2002/0008688 | A1 * | 1/2002 | Yamamoto et al. | 345/98 |

(Continued)

FOREIGN PATENT DOCUMENTS

JP 55-140889 11/1980

(Continued)

OTHER PUBLICATIONS

Korean Office Action for Application No. 10-2003-11307, dated Nov. 29, 2005 and English-language translation thereof.

(Continued)

*Primary Examiner*—Sumati Lefkowitz
*Assistant Examiner*—Tammy Pham
(74) *Attorney, Agent, or Firm*—Nixon & Vanderhye, PC

(57) ABSTRACT

An image display according to the present invention includes a driving device which performs pulse width modulation drive, restrains power consumption, and produces a good multi-tone display. The image display makes the difference between the scan line voltage and the signal line voltage equal in positive polarity writing and negative polarity writing by which pixels are AC driven, so as to make the on-resistances of transistors equal. This allows a maximum pulse width, the size of switching elements, etc. to be determined first so that they match positive polarity writing in which the resistances value of the switching elements rise. No high frequency clock is required to produce subtle differences of charge ratio in negative polarity writing in which the resistances of the switching elements fall. Power consumption which depends on the clock frequency drops too.

31 Claims, 17 Drawing Sheets

U.S. PATENT DOCUMENTS

| | | | | |
|---|---|---|---|---|
| 2002/0186193 | A1* | 12/2002 | Lee et al. | 345/96 |
| 2003/0034948 | A1* | 2/2003 | Imamura | |

FOREIGN PATENT DOCUMENTS

| | | |
|---|---|---|
| JP | 63-095420 | 4/1988 |
| JP | 01-126628 | 5/1989 |
| JP | 02-196218 | 8/1990 |
| JP | 3-62094 | 3/1991 |
| JP | 03-161790 | 7/1991 |
| JP | 04-095920 | 3/1992 |
| JP | 04-142592 | 5/1992 |
| JP | 06-167696 | 6/1994 |
| JP | 07-013518 | 1/1995 |
| JP | 07-248483 | 9/1995 |
| JP | 11-326870 | 11/1999 |
| JP | 2001-356745 | 12/2001 |

OTHER PUBLICATIONS

Translation of relevant passages of Japanese 55-140889/1980.
Translation of relevant passages of Japanese 3-62094/1991.
Translation of relevant passages of Japanese 11-326870/1999.

* cited by examiner

FIG. 13 *Conventional Art*
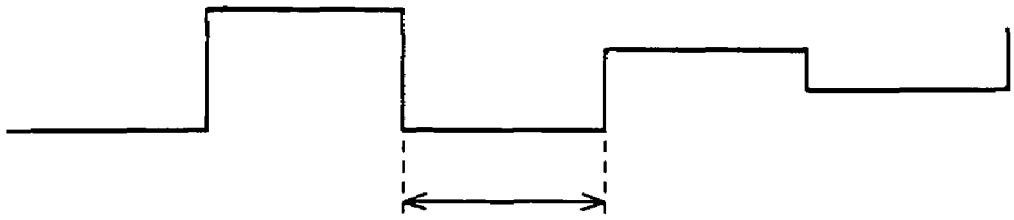
1H (1 HORIZONTAL) PERIOD
FIG. 14 *Conventional Art*
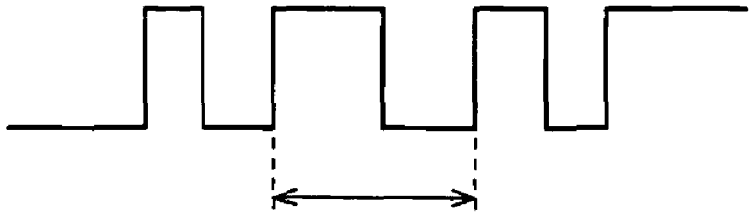
1H (1 HORIZONTAL) PERIOD FIG. 15 *Conventional Art*
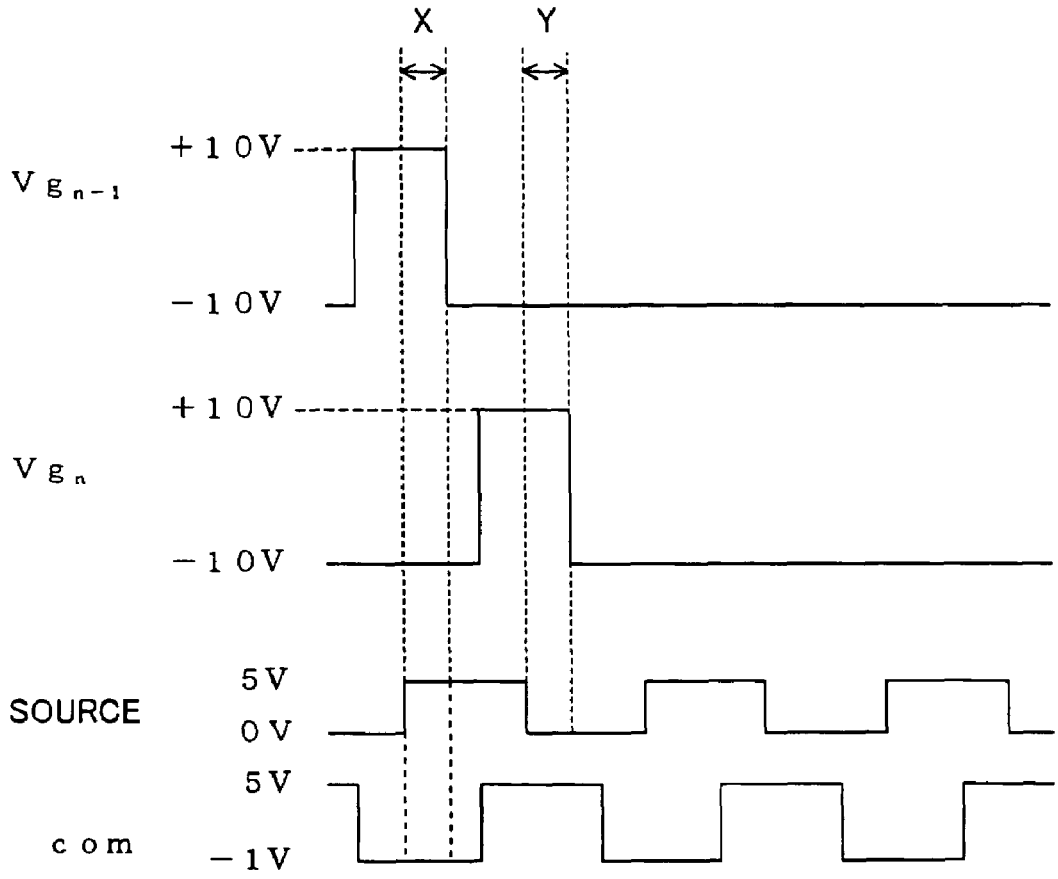

| REFERENCE VOLTAGE | BASED ON CHARGING | BASED ON DISCHARGING |
|---|---|---|
| | SIGNAL OUTPUT | SIGNAL OUTPUT |
| low | low → high | high → low |
| high | high → low | low → high |

METHOD OF DRIVING IMAGE DISPLAY, DRIVING DEVICE FOR IMAGE DISPLAY, AND IMAGE DISPLAY

FIELD OF THE INVENTION

The present invention relates to a method of driving an image display, a driving device for an image display, and an image display, in particular, to a method of driving an image display, a driving device for an image display, and an image display whereby an image is displayed by controlling a voltage written to a pixel electrode through adjustment of an application time of a signal line voltage applied to a signal line while a pixel switching element is in on state.

BACKGROUND OF THE INVENTION

Conventionally, image displays, such as active matrix liquid crystal displays using thin film transistors (TFTs) as pixel switching elements (hereinafter, "switching elements"), are in widespread use: the liquid crystal display (TFT-LCD) is an example. The liquid crystal display (LCD) in recent years has also found applications in personal digital assistants (PDAs), mobile phones, and like devices.

A conventional liquid crystal display is made up of pixel electrodes each provided for a different pixel on a substrate; switching elements connected to the pixel electrodes; scan lines for applying scan line voltages to the switching elements to switch the switching elements between on state and off state; signal lines for applying signal line voltages via the switching elements to the pixel electrodes; and common electrodes for applying common voltages to the pixels interposed between the pixel electrodes and the common electrodes.

In the structure, each transistor, acting as one of the switching elements, is connected at its gate to a scan line, at its source to a signal line, and at its drain to a pixel electrode. When a scan line voltage is applied to the gate and the switching element is in on state, the signal line voltage is applied to the pixel electrode via the resistor of the switching element, and a common voltage is applied to the common electrode. Consequently, the potential difference between the pixel electrode and the common electrode charges the pixel.

Note that the foregoing pixel, that is, liquid crystal, is a dielectric. Therefore, when a voltage is applied, the pixel electrode, the common electrode, and the pixel behave as a capacitor. Therefore, applying a voltage to that capacitor results in the pixel between the pixel electrode and the common electrode being charged according to the application voltage and the application time.

Also note that applying DC voltage across the pixel, that is, liquid crystal, degrades the liquid crystal, and to avoid that problem, AC voltage is applied in normal cases. Hereinafter, those cases in which, of AC voltages applied to the pixel, a positive voltage is being applied to the pixel as the difference between the signal line voltage and the common voltage will be referred to as positive polarity writing. Conversely, those cases in which a negative voltage is being applied to the pixel as the difference between the signal line voltage and the common voltage will be referred to as negative polarity writing.

In the structure, the liquid crystal display displays an image by applying signal line voltages having values associated with pixel data. The liquid crystal display is then adapted to repeat the foregoing action sequentially for one pixel after the other, covering the entire liquid crystal screen, so as to display an image.

Note that a conventional liquid crystal display employed the following drive method to display good tones.

The timing chart in FIG. 13 shows changes of the signal line voltage with time in the liquid crystal display. Time is represented by the horizontal axis, and the signal line voltage is represented by the vertical axis. A horizontal period in the figure refers to a duration in which on state is maintained by the application of scan line voltage (not shown).

Such a driving method like the one shown in FIG. 13 whereby the pixel application voltage value is varied by changing the signal line voltage value will be referred to as voltage modulation drive. By changing the signal line voltage value, the voltage modulation drive is capable of altering the pixel application voltage value and hence displaying tones according to the voltage values.

Switching elements used in the voltage modulation drive are designed so that they are capable of sufficiently writing signal line voltage to pixel electrodes, that is, they can achieve an almost 100% charge ratio (typically 99% or greater).

A charge ratio is a value indicative of a ratio of the signal line voltage applied to a signal line and the voltage written to a capacitor containing a pixel. If a voltage is applied to a pixel, the voltage written to the pixel gradually approaches with time the signal line voltage supplied to the signal line.

However, the voltage modulation drive is designed to use a predetermined circuit to produce a signal line voltage (tone voltage) having a desired value for application to a signal line. A problem arises here that the tone voltage producing circuit consumes electric power.

In contrast, further reductions in power consumption are required with personal digital assistants, mobile phones, and like devices which recently incorporate liquid crystal displays. Additional power consumption for tone voltage production as is the case with the voltage modulation drive is very problematic.

Accordingly, apart from the voltage modulation drive, pulse width modulation drive is suggested which necessitates no tone voltage producing circuit and supplies only an externally provided reference voltage to signal lines. Details follow.

FIG. 14 is a timing chart showing changes of the signal line voltage with time according pulse width modulation drive. The vertical and horizontal axes, as well as the horizontal period, in FIG. 14 have the same meaning as those in FIG. 13. In pulse width modulation drive, a change of the signal line voltage does not necessarily coincide with a change of the scan line voltage (not shown).

As shown in FIG. 14, the drive method adjusts the duration in which a signal line voltage is applied, so as to change the voltage written to pixels. As an alternative to the scheme shown in FIG. 14, the duration in which to apply a signal line voltage can be adjusted also by offsetting the time at which to change the signal line voltage and the time at which to change the scan line voltage (not shown). The alternative scheme is possible because voltage can be applied to pixels only when the scan line voltage is being in on state, and if the times are offset as in the foregoing, pixels are charged only in an on state.

Therefore, by changing the duration (pulse width) in which to apply a signal line voltage in on state, the voltage written to a pixel can be changed, and tones can be produced.

The pulse width modulation drive eliminates the need to change the value of the signal line voltage applied to a signal line to display tones. Accordingly, no tone voltage producing circuit is necessary, and power is saved as much as the amount consumed by that circuit. Further, since it is not necessary to provide a buffer for every signal line output, no power consumption could occur in the buffer. Accordingly, power consumption in the pulse width modulation is reduced compared to that of voltage modulation drive.

As an example of the drive method, Japanese Unexamined Patent Applications 55-140889/1980 (Tokukaisho 55-140889; published on Nov. 4, 1980) and 3-62094/1991 (Tokukaihei 3-62094; published on Mar. 18, 1991) disclose pulse width modulation drive based on two-value signal line voltage.

The drive method disclosed in these Applications is actually used in, for example, liquid crystal displays incorporating two-terminal MIM elements (metal-insulator-metal multilayer elements) as switching elements (MIM-LCD).

Further, for example, Japanese Unexamined Patent Application 11-326870/1999 (Tokukaihei 11-326870; published on Nov. 26, 1999) discloses a liquid crystal display incorporating MIM elements as switching elements for use in PDAs.

However, use of the conventional pulse width modulation drive has following problems.

To produce good multiple tones using a liquid crystal display, the value of the voltage written to every pixel needs to be adjusted in multiple stages in the first place. To adjust the voltage value in multiple stages by pulse width modulation drive, the duration in which a signal line voltage in an on state is applied, that is, the pulse width, is adjusted.

FIG. 15 is a timing chart showing changes of the scan line voltage, the signal line voltage, and the common voltage on a signal line with time. "$Vg_{n-1}$" and "$Vg_n$" represent scan line voltages applied to (n−1)-th and n-th scan lines respectively, "SOURCE" the signal line voltage, and "com" the common voltage. As shown in the figure, the on-state scan line voltage is +10 V.

In the period X in FIG. 15 in which only positive polarity writing is performed, the scan line voltage on the (n−1)-th scan line is +10 V and therefore on state, and the difference between the signal line voltage and the common voltage, 5 V-(−1 V)=6 V. is applied to the pixel located where the aforementioned signal line meets the (n−1)-th scan line.

Note that the signal line voltage is +5 V, whereas the scan line voltage is +10 V. Therefore, in positive polarity writing, the difference between the scan line voltage and the signal line voltage is +5 V.

In contrast, in the period Y in FIG. 15 in which only negative polarity writing is performed, the scan line voltage on the n-th scan line is +10 V and on state, and the difference between the signal line voltage and the common voltage, 0 V-(5 V)=−5 V, is applied to the pixel on the n-th scan line.

Note that the signal line voltage is 0 V, whereas the scan line voltage is +10 V. Therefore, in negative polarity writing, the difference between the scan line voltage and the signal line voltage is +10 V.

As described in the foregoing, in the conventional image display, the difference between the scan line voltage and the signal line voltage, that is, the difference between the voltages applied to the gate and the source of the pixel switching element, is made to differ between positive polarity writing and negative polarity writing.

As a result, the on-resistance of the transistor differs between positive polarity writing and negative polarity writing. Therefore, the current flow through the transistor also differs between positive polarity writing and negative polarity writing. As a result, different pulse widths are used upon writing between positive polarity writing and negative polarity writing.

Note that an "on-resistance" is a value indicating the current supply capability of a transistor and has such a property that it decreases progressively in value as the difference between the voltage applied to the pixel (source voltage) and the gate voltage grows.

Under such circumstances, to produce a precise tone display both by positive polarity writing and by negative polarity writing, the maximum pulse width, the size of the switching element, etc. should be determined first in accordance with positive polarity writing whereby the switching element has a higher resistance value, and a high frequency clock is necessary to produce subtle differences of the charge ratio in negative polarity writing whereby the switching element has a lower resistance value. As a result, an inevitable problem arises that power consumption grows.

SUMMARY OF THE INVENTION

Conceived in view of the foregoing problems, the present invention has an objective to offer a method of driving an image display, a driving device for an image display, and an image display, whereby the image display operates with pulse width modulation drive, displaying good multiple tones on limited power consumption.

The present invention has another objective to offer a method of driving an image display, a driving device for an image display, and an image display, whereby the charge quantities of pixels are precisely controlled to display more precise tones.

To accomplish the objectives, a method of driving an image display in accordance with the present invention involves applying a scan line voltage to a scan line so as to switch, between on state and off state, pixel switching elements connected to pixel electrodes each provided for a different pixel on a substrate, applying a signal line voltage to a signal line connected to the pixel electrodes through the pixel switching elements when the pixel switching elements are in the on state, applying a common voltage to a common electrode sandwiching the pixels between the same and the pixel electrodes, and while AC driving the pixels, adjusting a pulse width of the signal line voltage for the AC driving when the pixel switching elements are in the on state, so as to control display tones, wherein the scan line voltage and the signal line voltage are caused to differ from each other equally in positive polarity writing and negative polarity writing of the AC driving.

Note that a pulse width is defined as the duration in which to apply a signal line voltage in on state.

Further, positive polarity writing refers to those cases where, of AC voltages applied to a pixel, a positive voltage is being applied to the pixel as the difference between the signal line voltage and the common voltage. Negative polarity writing refers to those cases where a negative voltage is being applied to the pixel as the difference between the signal line voltage and the common voltage.

With this arrangement, the difference between the scan line voltage and the signal line voltage in positive polarity writing of AC driving is equal to that in negative polarity writing. That is, the potential difference between the gate and the source becomes the same in positive polarity writing and in negative polarity writing.

Therefore, the transistor on-resistance is the same in positive polarity writing and in negative polarity writing.

Note that an on-resistance is a value indicating the current supply capability of a transistor and has such a property that it decreases progressively in value as the difference between the voltage applied to the pixel (source voltage) and the gate voltage grows.

In other words, if the transistor on-resistance differs in positive polarity writing and negative polarity writing, tones need to be displayed by changing a pixel-charging pulse width between positive polarity writing and negative polarity writing. The method of driving an image display in accordance with the present invention eliminates the need for such an action. Therefore, the maximum pulse width, the size of the switching element, etc. does not need to be determined first in accordance with positive polarity writing whereby the switching element has a higher resistance value, and a high frequency clock is not necessary to produce subtle differences of a charge ratio in negative polarity writing whereby the switching element has a lower resistance value; at the same time, power consumption depending on the clock frequency can be reduced.

More specifically, since an optimum opposite voltage varies due to the differing capacitance in the part of the liquid crystal layer, only a difference for compensation with that variation being taken into account, that is, only a difference in timing, needs to be provided. That is, the liquid crystal changes its dielectric constant depending on the voltage applied and is therefore to a varying degree depending on the voltage applied influenced by the parasitic capacitance of a TFT which is a switching element. Therefore, in pulse width modulation drive, the pulse width needs to differ in positive polarity writing and negative polarity writing to compensate for the influence, even when the TFT on-resistance is totally the same in positive polarity writing and in negative polarity writing according to the arrangement. In cases where the on-resistance differs greatly between positive polarity writing and negative polarity writing, the contribution from the on-resistance difference must be further adjusted in timing; the present invention, however, can reduce the difference in timing only to the value intended for the aforementioned compensation.

Further, according to the arrangement, the voltage difference between the gate and the source is made the same in positive polarity writing and in negative polarity writing; therefore, the transistor resistance value can be prevented from falling to too low a value in negative polarity writing with a low signal line voltage.

Note that in the arrangement, the difference between the scan line voltage and the signal line voltage is supposed to be equal. "Equal" here does not need to be interpreted strictly. The present invention is also applicable to arrangements in which the difference between the scan line voltage and the signal line voltage is sufficiently equal in positive polarity writing and in negative polarity writing. Such arrangements can also decrease the difference in timing in positive polarity writing and negative polarity writing compared to conventional cases as mentioned in the foregoing.

Further, a method of driving an image display in accordance with the present invention, to accomplish the objectives, involves applying a scan line voltage to a scan line so as to switch, between on state and off state, pixel switching elements connected to pixel electrodes each provided for a different pixel on a substrate, applying a signal line voltage to a signal line connected to the pixel electrodes through the pixel switching elements when the pixel switching elements are in the on state, applying a common voltage to a common electrode sandwiching the pixels between the same and the pixel electrodes, and while AC driving the pixels, adjusting a pulse width of the signal line voltage for the AC driving when the pixel switching elements are in the on state, so as to control display tones, wherein: the signal line voltage and the common voltage are made equal to each other so as to discharge the pixels when the pixel switching elements are in the on state; and the signal line voltage is changed to charge the pixels.

According to the arrangement, while the scan line voltage is in on state, the signal line voltage and the common voltage are caused to have the same polarity so as to discharge the pixels. Thereafter while the scan line voltage is still in on state, the polarity of the signal line voltage is inverted to charge the pixels.

Since the pixels are charged after being discharged, the pixel charge quantity can be more precisely controlled and tones can be more precisely displayed, regardless of the previous charge quantity.

Note that as described in the foregoing, the pixels sandwiched between the pixel electrodes and the common electrode behave as capacitors when voltage is applied to them. If the voltage value maintained by the capacitor varies, the capacitor-charging action produces different voltage values even when new voltage application is performed for the same duration. Therefore, unless the pixels are charged only after being discharged first as in the forgoing, the actual voltage somewhat differs from the target value. In other words, if the pixels are charged only after being discharged as in the method of driving an image display in accordance with the present invention, the pixels can be charged producing no offset from the target voltage, and a precise tone display can be carried out.

Further, according to the arrangement, the pixels are discharged first before being charged for every round of writing. In moving picture and other like cases where the display tone changes for every round of writing, the image can be more precisely displayed.

Further, in the arrangement, it is preferred if the signal line voltage and the common voltage have the same polarity when the scan line voltage is turned into on state. According to the arrangement, wasteful charging is prevented: for example, it is prevented that the signal line voltage and the common voltage have opposite polarity when the scan line voltage is turned into on state and later made to have the same polarity to discharge the pixels.

Further, a method of driving an image display in accordance with the present invention, to accomplish the objectives, involves applying a scan line voltage to a scan line so as to switch, between on state and off state, pixel switching elements connected to pixel electrodes each provided for a different pixel on a substrate, applying a signal line voltage to a signal line connected to the pixel electrodes through the pixel switching elements when the pixel switching elements are in the on state, applying a common voltage to a common electrode sandwiching the pixels between the same and the pixel electrodes, and while AC driving the pixels, adjusting a pulse width of the signal line voltage for the AC driving when the pixel switching elements are in the on state, so as to control display tones, wherein: the signal line voltage and the common voltage are changed simultaneously while the signal line voltage and the common voltage are being made equal to each other to discharge those of the pixels which are connected to the on-state pixel switching elements; and the signal line voltage is changed to charge the pixels.

According to the arrangement, the common voltage is inverted in polarity during a discharge action; therefore, the pixel-charging voltage never rises up to or exceeding the signal line voltage or the common voltage. As a result, the voltage indicating that the scan line signal is on can be lowered.

That is, by so doing, the voltage indicating that the scan line signal is on can be selected and specified from a wider range. For example, an optimum value is selectable which makes it easy for the on-resistance value of the transistor to control the charge ratio. Further, selecting a lowest possible voltage as the voltage indicating that the scan line signal is on will reduce power consumption. Besides, operation in specifying various pulse widths for a multi-tone display can be greatly facilitated.

Further, a method of driving an image display in accordance with the present invention, to accomplish the objectives, involves applying a scan line voltage to a scan line so as to switch, between on state and off state, pixel switching elements connected to pixel electrodes each provided for a different pixel on a substrate, applying a signal line voltage to a signal line connected to the pixel electrodes through the pixel switching elements when the pixel switching elements are in the on state, applying a common voltage to a common electrode sandwiching the pixels between the same and the pixel electrodes, and while AC driving the pixels, adjusting a pulse width of the signal line voltage for the AC driving when the pixel switching elements are in the on state, so as to control display tones, wherein: the scan line voltage has two values representing the on state, one of the two values of the scan line voltage representing the on state being less than a sum of a higher positive value of the signal line voltage and an amplitude of the common voltage; the signal line voltage and the common voltage are changed simultaneously while the signal line voltage and the common voltage are being made equal to each other to discharge those of the pixels which are connected to the on-state pixel switching elements; and the signal line voltage is changed to charge the pixels.

According to the arrangement, the common voltage is inverted in polarity during a discharge action; therefore, the pixel-charging voltage never rises up to or exceeding the signal line voltage or the common voltage. As a result, the voltage indicating that the scan line signal is on can be lowered.

That is, if one of the two values of the scan line voltage representing the on state is less than a sum of a higher positive value of the signal line voltage and an amplitude of the common voltage as in the arrangement, power consumption can be further reduced.

Further, a method of driving an image display in accordance with the present invention, to accomplish the objectives, involves applying a scan line voltage to a scan line so as to switch, between on state and off state, pixel switching elements connected to pixel electrodes each provided for a different pixel on a substrate, applying a signal line voltage to a signal line connected to the pixel electrodes through the pixel switching elements when the pixel switching elements are in the on state, applying a common voltage to a common electrode sandwiching the pixels between the same and the pixel electrodes, and while AC driving the pixels, adjusting a pulse width of the signal line voltage for the AC driving when the pixel switching elements are in the on state, so as to control display tones, wherein: the scan line voltage has two values representing the on state; the signal line voltage and the common voltage are made equal to each other so as to discharge the pixels while the scan line voltage is having a higher one of the two values when the pixel switching elements are in the on state; and the signal line voltage is changed to charge the pixels.

According to the arrangement, the discharge action preceding negative polarity writing can be done in a short time, and time-related versatility improves such as shortened horizontal cycles and extended time periods allocated for charging actions.

Further, a driving device for an image display in accordance with the present invention, to accomplish the objectives, includes: pixel electrodes each provided for a different pixel on a substrate; scan lines which apply a scan line voltage to pixel switching elements connected to the pixel electrodes so as to switch the pixel switching elements between on state and off state; signal lines which apply a signal line voltage to the pixel electrodes through the pixel switching elements; and common electrodes which apply a common voltage to the pixels sandwiched between the same and the pixel electrodes, wherein while the pixels are being AC driven, a pulse width of the signal line voltage for the AC driving when the pixel switching elements are in the on state is adjusted, so as to control a voltage written to the pixels for a display of tones, wherein the scan line voltage and the signal line voltage are caused to differ from each other equally in positive polarity writing and negative polarity writing of the AC driving.

According to the arrangement, the aforementioned method of driving an image display can be realized in driving devices for an image display. Therefore, the same effects as those mentioned earlier can be achieved.

Further, an image display in accordance with the present invention, to accomplish the objectives, includes: pixel electrodes each provided for a different pixel on a substrate; scan lines which apply a scan line voltage to pixel switching elements connected to the pixel electrodes so as to switch the pixel switching elements between on state and off state; signal lines which apply a signal line voltage to the pixel electrodes through the pixel switching elements; common electrodes which apply a common voltage to the pixels sandwiched between the same and the pixel electrodes; and a voltage driving section which supplies the scan line voltage to the scan lines, the signal line voltage to the signal lines, and the common voltage to the common electrode, wherein: the voltage driving section, while AC driving the pixels, adjusts a pulse width of the signal line voltage for the AC driving when the pixel switching elements are in the on state so as to control a voltage written to the pixels for a display of tones; and the scan line voltage and the signal line voltage are caused to differ from each other equally in positive polarity writing and negative polarity writing of the AC driving.

According to the arrangement, the aforementioned method of driving an image display can be realized in image displays. Therefore, the same effects as those in the foregoing can be achieved.

Additional objects, advantages and novel features of the invention will be set forth in part in the description which follows, and in part will become apparent to those skilled in the art upon examination of the following or may be learned by practice of the invention.

BRIEF DESCRIPTION OF THE DRAWINGS

FIG. 13 is a timing chart showing a source signal (signal line voltage) waveform in conventional voltage modulation drive.

FIG. 14 is a timing chart showing a source signal (signal line voltage) waveform in conventional pulse width modulation drive.

FIG. 15 is a timing chart showing a conventional drive signal.

DESCRIPTION OF THE EMBODIMENTS

The following will describe an embodiment of the present invention in reference to the figures.

Embodiment 1

The following will describe an embodiment of the present invention in reference to figures.

A driving device for an image display in accordance with the present embodiment applies voltages to, and hence drives, pixels in a liquid crystal display (TFT-LCD), so that an image is displayed. The present invention is by no means limited to the present embodiment and applicable to displays which control the display of tones through pixel application voltage values.

Figure 18:
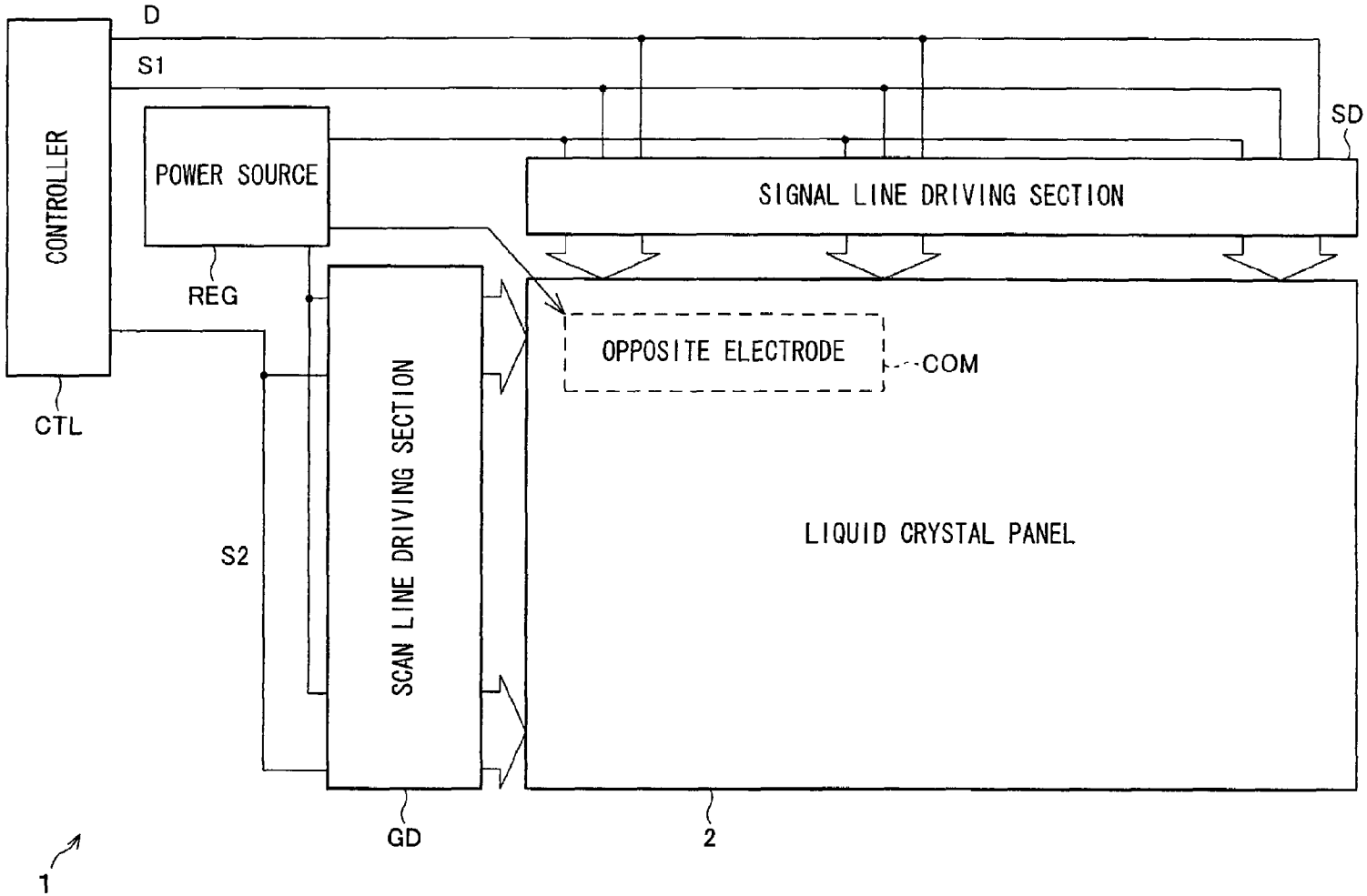
FIG. 18 is a block diagram schematically showing an embodiment of an image display in accordance with the present invention.

Schematically, an image display 1 in accordance with the present embodiment, as shown in FIG. 18, contains a liquid crystal panel 2, a controller CTL, a power source REG, a scan line driving section GD, and a signal line driving section SD.

Figure 2:
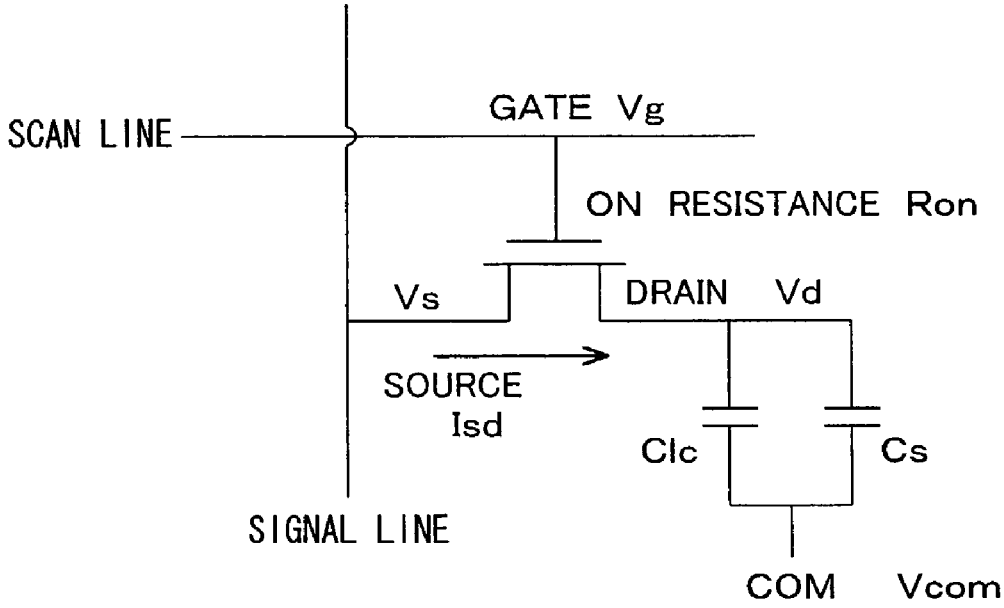
FIG. 2 is a circuit diagram showing an equivalent circuit of a unit pixel in an embodiment of the present invention.

FIG. 2 is a circuit diagram of a pixel (unit pixel) in a liquid crystal panel 2 of the liquid crystal display. In the liquid crystal display, such unit pixels are provided in a matrix form across the panel.

FIG. 2 also shows part of a driving device for an image display in accordance with the present embodiment. The driving device for an image display in accordance with the present embodiment is made up of pixel electrodes, each of which is provided for a different pixel to drive that pixel; scan lines through which to apply scan line voltages to pixel switching elements connected to the pixel electrodes to switch between on state and off state; signal lines through which signal line voltages are applied to the pixel electrodes; and common electrodes through which common voltages are applied to the pixels sandwiched between the same and the pixel electrodes.

The "pixel electrode" refers to the drain-side electric plate of the capacitor designated by Clc. The "pixel switching element connected to the pixel electrode" is the transistor, or TFT (thin film transistor) shown in the figure. The "common electrode" is the COM-side electric plate of the capacitor Clc. The pixel is provided between the electric plates of the capacitor Clc and not shown in FIG. 2. Apart from the liquid crystal capacitor Clc, a supplemental capacitor Cs is also shown as pixel capacitance.

In the present embodiment, a scan line voltage, a signal line voltage, and a common voltage (common potential) Vcom are applied respectively to the scan line, the signal line, and an opposite electrode (common electrode) designated by COM in FIG. 2. That is, in the transistor, the scan line voltage and the signal line voltage are applied respectively to the gate (scan line electrode) and the source (signal line electrode). The difference between the drain voltage and the common voltage applied to the common electrode is applied to the pixel.

The scan line voltage, the signal line voltage, and the common voltage are generated by a voltage driving section which contains, as shown in FIG. 18, the power source REG, the scan line driving section GD, and the signal line driving section SD.

The power source REG supplies voltage to the scan line driving section GD and the signal line driving section SD and also functions as a common voltage supply section supplying a common voltage to the opposite electrode COM.

The scan line driving section GD generates, and supplies to the scan line, a scan line voltage in accordance with the voltage from the power source REG and a control signal S2 from the controller CTL. The control signal S2 includes a vertical synchronization signal and a clock signal for the scan line driving section.

Note that the controller CTL is for supplying the control signals S2, S1 and display data D to the scan line driving section GD and the signal line driving section SD respectively.

The signal line driving section SD generates, and supplies to the signal line, a signal line voltage in accordance with the voltage from the power source REG and the control signal S1 and the display data D from the controller CTL. The control signal S1 includes a horizontal synchronization signal, a vertical synchronization signal, and a clock signal for the signal line driving section.

Figure 3:
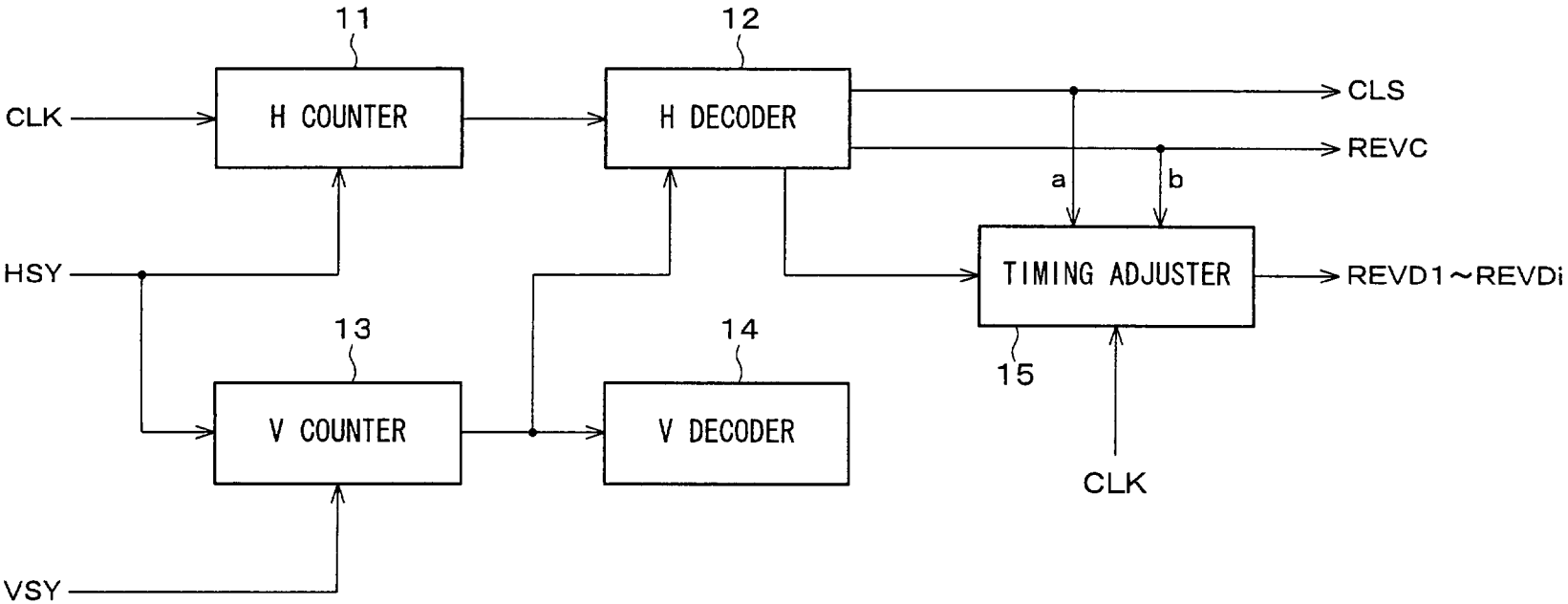
FIG. 3 is a block diagram showing, as an example, an arrangement of a circuit which shifts the phases of waveforms on signal lines in an embodiment of the present invention.
Figure 4:
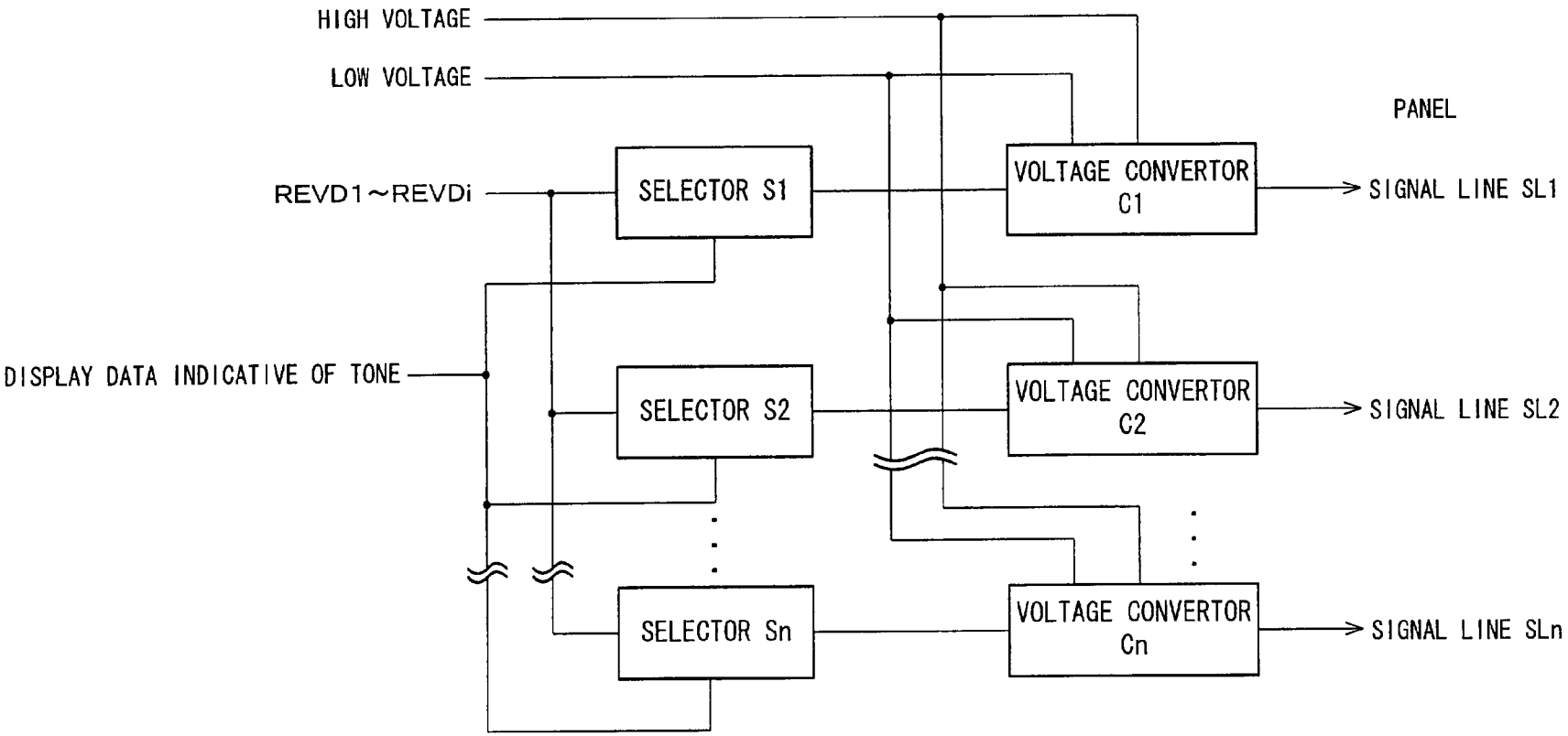
FIG. 4 is a block diagram showing, as an example, an arrangement of a circuit which outputs signals on signal lines in an embodiment of the present invention.

Now, FIG. 3 and FIG. 4 show the arrangement of the signal line driving section in more detail.

Referring to FIG. 3 and FIG. 4, the signal line driving section contains an H counter 11, an H decoder 12, a V counter 13, a V decoder 14, a timing adjuster 15, selectors S1 to Sn, and voltage converters Cl to Cn.

The H counter 11 receives a clock CLK and a horizontal synchronization signal HSY and outputs a signal to the H decoder 12. The V counter 13 receives the horizontal synchronization signal HSY and a vertical synchronization signal VSY and outputs a signal to the H decoder 12 and the V decoder 14.

The H decoder 12 receives output signals from the H counter 11 and the V counter 13 and outputs a timing pulse CLS for the scan line signal (clock for a gate driver) and a timing pulse REVC for a common electrode signal.

The V decoder 14 receives the output from the V counter 13.

The timing adjuster 15 is adapted to receive the clock CLK and output all timing pulses REVD1 to REVDi (will be referred to as "REVD") for a signal line signal, which are signals totaling i, to the selectors S1 to Sn in FIG. 4 based on CLS or REVC.

Note that REVD1 to REVDi are timing pulses for the signal line voltage applied to the signal lines in accordance with data of 1 tone to i tones respectively. In the present embodiment, tones are displayed by arranging the phase of the waveform on the signal line shifting off the phase of the waveform on the scan line or on the common electrode. Accordingly, the phase difference varies from one tone to the other. REVD is specified to invert at the same inversion cycle similar as REVC. Accordingly, REVD has the same cycle as CLS.

The selectors S1 to Sn receive REVD and data indicative of tones to be displayed. For example, the selector Si ($1 \leqq i \leqq n$) is adapted to, upon reception of an associated timing pulse REVDi for a signal line signal, output the data indicative of tones to the timing adjuster 15.

The timing adjuster 15 selects an input signal designated by "a" in the figure to regulate a signal timing (REVD) for the signal line on the basis of the phase difference from CLS and an input signal designated by "b" in the figure to regulate a signal timing (REVD) for the signal line on the basis of the phase difference from REVC. That is, the timing adjuster 15 adjusts REVD timings on the basis of a signal selected between "a" and "b." By so doing, the phase difference can be now specified between the signal on the signal line and either the signal on the scan line or the drive signal on the common electrode, enabling a tone display.

Figures 19, 20:
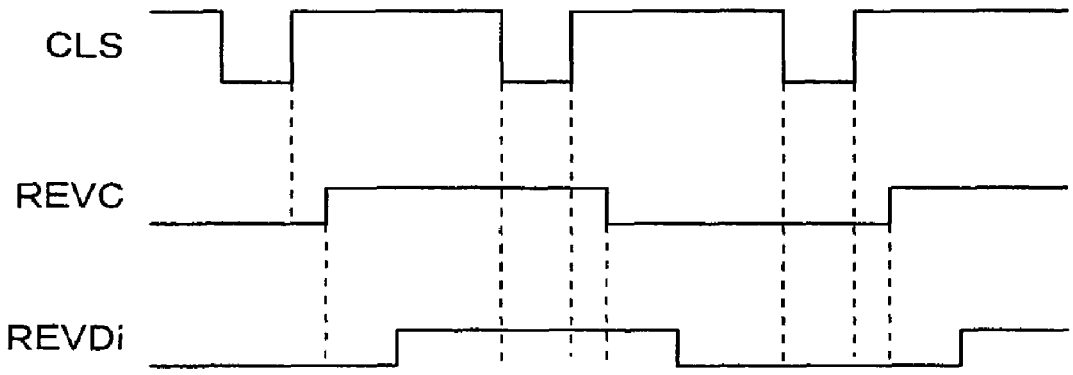
FIG. 19 is a timing chart showing timings of the signals in FIG. 3.
FIG. 20 is an explanatory drawing showing signal outputs in the arrangement in FIG. 4.

The timings of these signals are shown in FIG. 19. Although the figure is simplified for convenience in description and illustrates only REVDi, i signals are generated likewise. The phases of REVD1 to REVDi may be shifted with respect to CLS or to REVC.

The phase of the waveform on the signal line can be shifted with respect to the phase of the waveform on the scan line using circuit thus arranged. The timing adjuster 15 outputs REVD1 to REVDi in accordance with data on how much to shift the phase of the waveform on the signal line with respect to the phase of the waveform on the scan line provided on the basis of a CLS timing. As shown in FIG. 4, in cases where n signal lines SL1 to SLn are to be driven, the timings for the pulses applied to a signal line are sequentially selected from REVD1 to REVDi using selectors (S1 to Sn). This enables the output of HIGH and LOW potential at desired intervals as the signal line voltage.

That is, when n signal lines SL1 to SLn are to be driven, one of REVD1 to REVDi is selected for each signal line in accordance with display data. If high/low potential (HIGH/LOW) is selected for each signal line according to the timing given by the selected REVD, a desired voltage waveform according to the tone is supplied to that signal line.

The arrangement in FIG. 3 is also applicable when the phase of the waveform on the signal line is shifted with respect to the phase of the AC (binary) waveform at the common electrode, in which case the difference from the foregoing case lies where the timing adjuster 15 outputs REVD1 to REVDi in accordance with data on how much to shift the phase of the waveform on the signal line with respect to the phase of the waveform at the common electrode produced on the basis of the REVC timing.

FIG. 20 shows signal outputs of the voltage converters (C1 to Cn). The signals are grouped by the voltages acting as references (reference voltages) and whether tones are displayed by charging or discharging.

When tones are displayed by charging, if the reference voltage is LOW, the signal output changes from LOW to HIGH; if the reference voltage is HIGH, the signal output changes from HIGH to LOW. The difference between the signal line potential (signal line voltage) and the common electrode potential (common voltage) increases in accordance with the time taken by the change, and the pixel capacitor charges in accordance with the increased difference in potential.

When tones are displayed by discharging, if the reference voltage is LOW, the signal output changes from HIGH to LOW; if the reference voltage is HIGH, the signal output changes from LOW to HIGH. The difference between the signal line potential (signal line voltage) and the common electrode potential (common voltage) decreases in accordance with the time taken by the change, and the pixel capacitor discharges in accordance with the decreased difference in potential. Tones are displayed in this manner in accordance with the pixel potential after the charge/discharge.

A detailed example of the scan line voltage, the signal line voltage, the common voltage in the present embodiment will be given later.

Further, in the driving device for an image display in accordance with the present embodiment, when the pixel is charged, the potential difference between the gate and the source can be made the same for positive charging and negative charging in the case of AC drive.

Note that hereinafter, those cases in which, of the AC voltage applied to the pixel, a positive voltage is being applied to the pixel as the difference between the signal line voltage and the common voltage will be referred to as positive polarity writing and conversely, those cases in which a negative voltage is being applied to the pixel as the difference between the signal line voltage and the common voltage will be referred to as negative polarity writing. As a result, in the present embodiment, the timing pulses REVD1 to REVDi for the signal line signals can be used in the same manner in the positive polarity cases and the negative polarity cases.

Now, the operation of the driving device for an image display in accordance with the present embodiment in the arrangement will be described in reference to figures.

Figure 1:
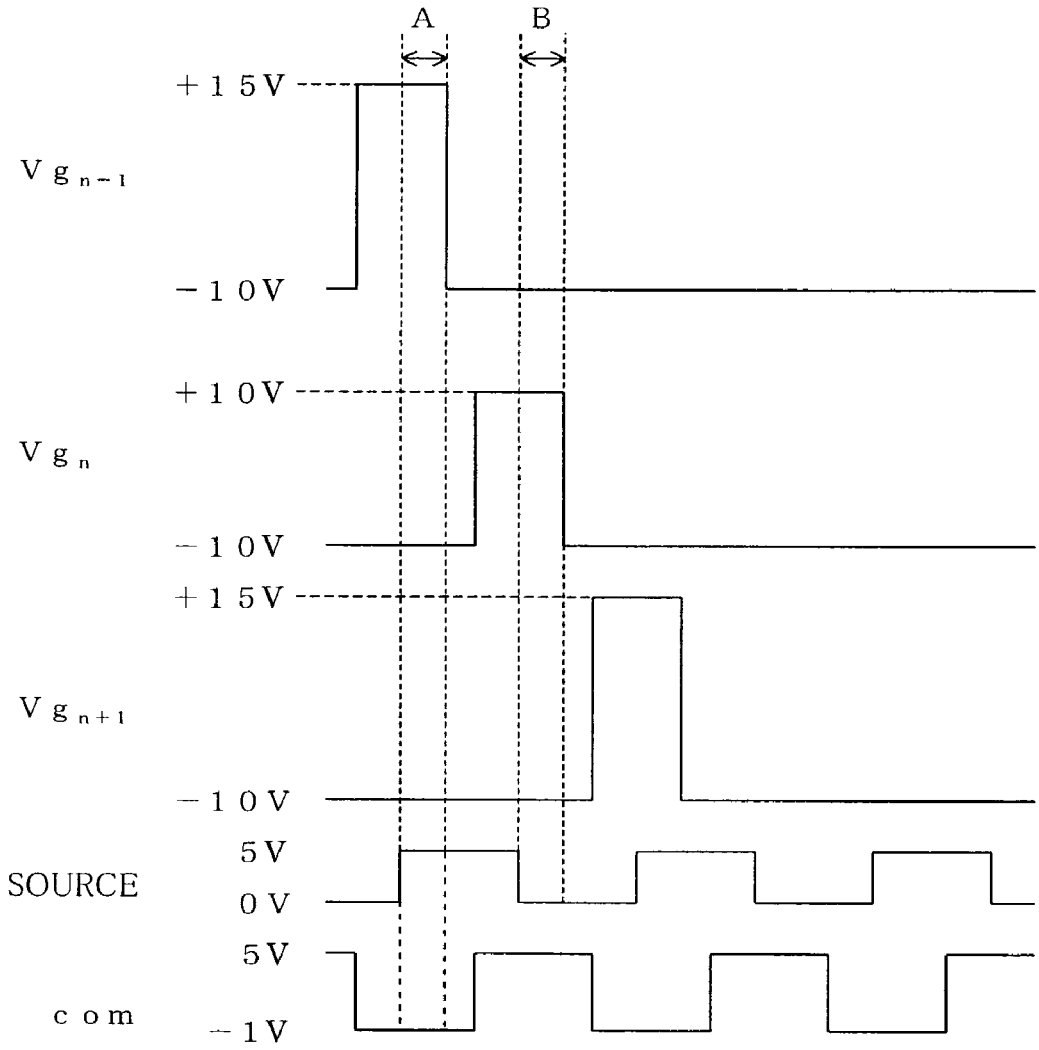
FIG. 1 is a timing chart showing a drive signal in an embodiment of the present invention.

FIG. 1 is a timing chart showing temporal changes of the scan line voltage, the signal line voltage, and the common voltage on a given signal line, where "$Vg_{n-1}$," "$Vg_n$," and "$Vg_{n+1}$" indicate scan line voltages applied to the (n−1)-th, n-th, and (n+1)-th scan lines respectively, "source" the signal line voltage, and "com" the common voltage.

As shown in the figure, in the present embodiment, the on state of the scan line voltage is represented by two values: +15 V and +10 V.

Period A in FIG. 1 is a period to perform the aforementioned positive polarity writing. In period A, the scan line voltage on the (n−1)-th scan line is +15 V, indicating that the line is in on state, and the difference between the signal line voltage and the common voltage, 5 V-(−1 V)=6 V, is applied to the pixels on the (n+1)-th scan line. Note that the duration of a period, for example, period A, in which voltage is actually applied to the pixel is referred to as a "pulse width.

Note that the scan line voltage is +15 V, whereas the signal line voltage is +5 V. In positive polarity writing, the difference between the scan line voltage and the signal line voltage is therefore +10 V.

Period B in FIG. 1 is a period to perform the aforementioned negative polarity writing. In period B, the scan line voltage on the n-th scan line is +10 V, indicating that the line is in on state, and the difference between the signal line voltage and the common voltage, 0 V−(5 V)=−5 V, is applied to the pixels on the n-th scan line.

Note that the scan line voltage is +10 V, whereas the signal line voltage is 0 V. In negative polarity writing, the difference between the scan line voltage and the signal line voltage is therefore +10 V.

As described in the foregoing, in the driving device for an image display in accordance with the present embodiment, the difference between the scan line voltage and the signal line voltage is +10 V both in positive polarity writing and in negative polarity writing as in the foregoing. That is, both in positive polarity writing and in negative polarity writing, the difference between the voltage applied to the gate of the transistor and the voltage applied to the source is 10 V; therefore, no great difference develops in the on-resistance of the transistor.

Therefore, the current flow through the transistor is also the same in positive polarity writing and negative polarity writing. Consequently, the same writing pulse width can be used in positive polarity writing and negative polarity writing.

As a result, when the timing pulses REVD1 to REVDi for the signal line signals are used, no extreme difference needs to be provided between positive polarity writing and negative polarity writing, which makes it possible to deal with the two polarity writings similarly. More specifically, since an optimum opposite voltage varies due to the differing capacitance in the part of the liquid crystal layer, only a difference for compensation with that variation being taken into account, that is, only a difference in timing, needs to be provided. If the difference in on-resistance between positive polarity writing and negative polarity writing is excessively large, the difference in on-resistance must be adjusted by means of timing; the difference in timing can be reduced by the present invention.

In cases of, for example, conventional technology, to provide a difference in timing in positive polarity writing and negative polarity writing, one horizontal period typically needs to be divided further down. As a result, a difference in timing needs to be realized by speeding up the basic clock signal, extending one horizontal period, or another means.

In contrast, the driving device for an image display in accordance with the present embodiment does not need such a means. As a result, difference in timing can be achieved more easily.

Note that the present embodiment has dealt with AC common voltage in FIG. 1, but is by no means limiting the present invention. For example, a DC common voltage may be used as shown in FIG. 5 as another embodiment.

Figure 5:
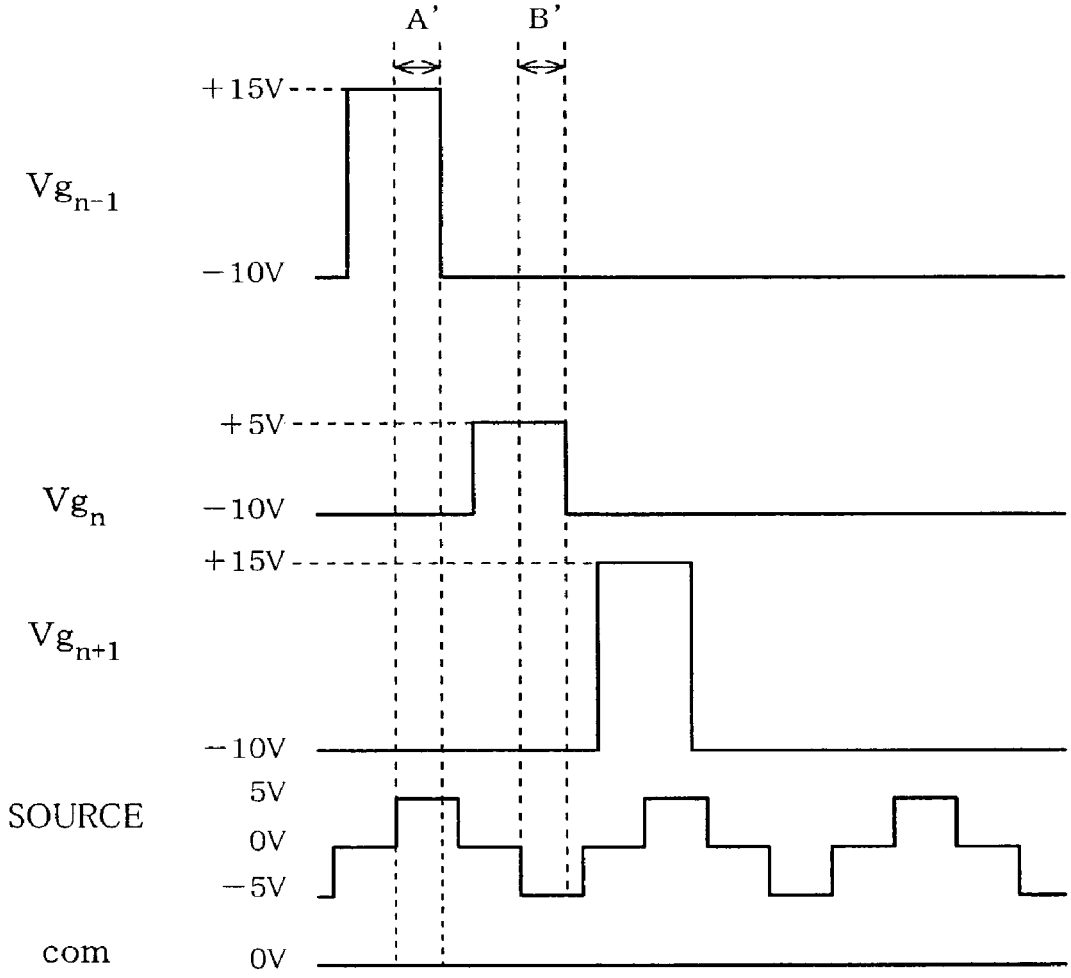
FIG. 5 is a timing chart showing a drive signal in an embodiment of the present invention.

FIG. 5 is a timing chart showing temporal changes of the scan line voltage, the signal line voltage, and the common voltage on a given signal line, where "$Vg_{n-1}$," "$Vg_n$," and "$Vg_{n+1}$" indicate scan line voltages applied to the (n−1)-th, n-th, and (n+1)-th scan lines respectively, "source" the signal line voltage, and "com" the common voltage.

In this case, the signal line voltage alternates between +5 V and −5 V, and the associated on-voltage on the scan line alternates between +15 V and +5 V. In this case, the difference between the scan line voltage and the signal line voltage is again +10 V in the aforementioned positive polarity writing (period A') and negative polarity writing (period B'). Therefore, the same effects as in the foregoing can be achieved.

Now referring to FIG. 2, in the present embodiment, the liquid crystal capacitor Clc and the supplemental capacitor Cs are supposed to be at the same potential (=common potential Vcom); they may be however at different potentials. Further, the opposite electrode COM may be linear.

Embodiment 2

The following will describe another embodiment of the present invention in reference to figures.

A driving device for an image display in accordance with the present embodiment has a similar arrangement to that of the driving device for an image display set forth in embodiment 1. Further, an image display in accordance with the present embodiment has a similar arrangement to that of the image display set forth in embodiment 1. The present embodiment differs from embodiment 1 in timings of temporal changes of the scan line voltage, the signal line voltage, and the common voltage. The following will describe these differences.

Now, the operation of the driving device for an image display in accordance with the present embodiment in the arrangement will be described in reference to figures.

Figure 6:
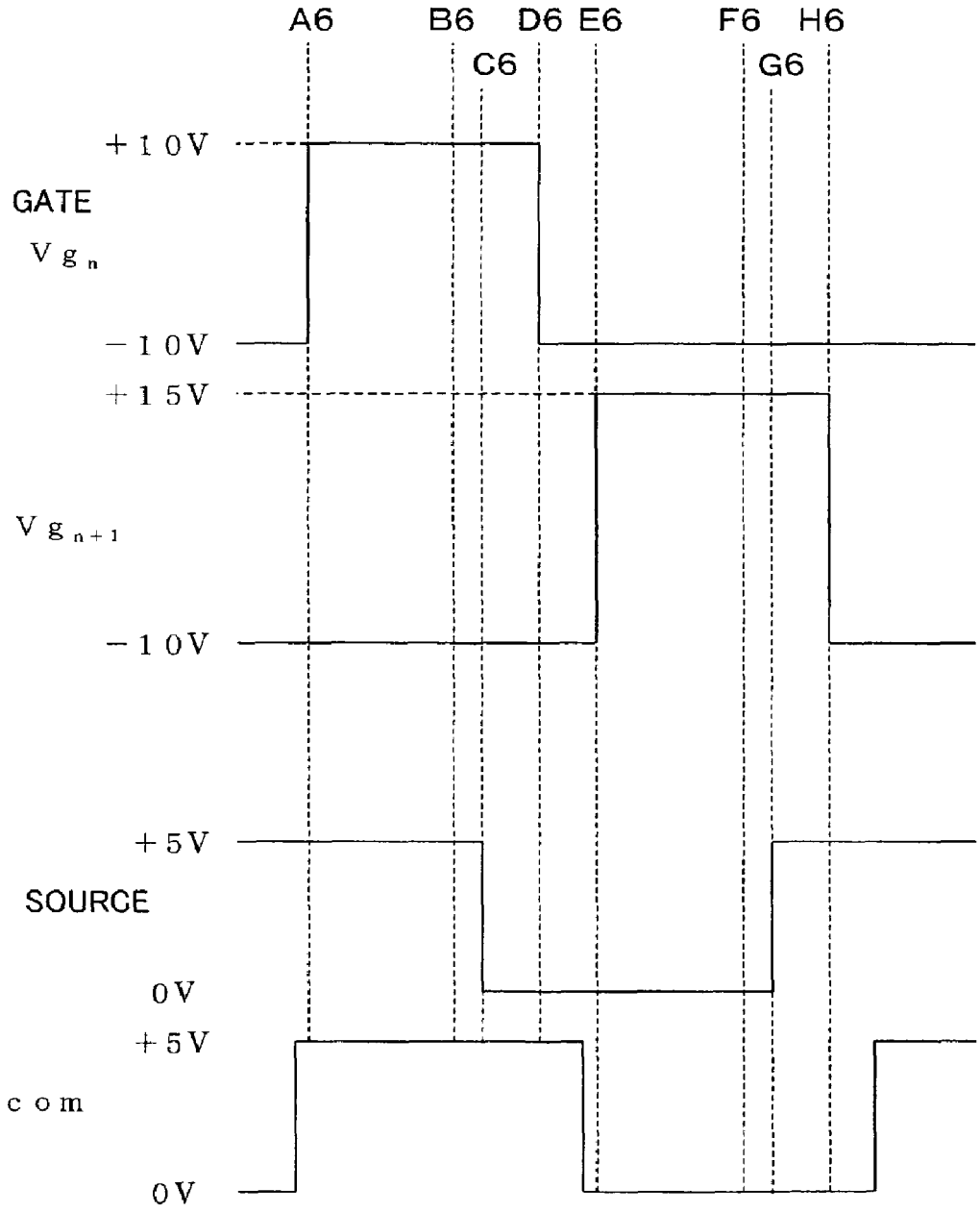
FIG. 6 is a timing chart showing a drive signal in another embodiment of the present invention.

FIG. 6 is a timing chart showing temporal changes of the scan line voltage, the signal line voltage, and the common voltage, where "$Vg_n$" and "$Vg_{n+1}$" indicate scan line voltages applied to the n-th and (n+1)-th scan lines respectively, "source" the signal line voltage, and "com" the common voltage.

As shown in the figure, in the present embodiment, the on state of the scan line voltage is represented by two values: +10 V and +15 V.

Note that the polarity of the signal line voltage or the common voltage indicates that the voltage is either at a HIGH or at a LOW. That is, for example, the signal line voltage and the common voltage having the same polarity means that both the signal line voltage and the common voltage are either at a HIGH or at a LOW.

Note that in the present embodiment, the signal line voltage alternates between two values, 0 V and +5 V, and the common voltage alternates between two values, 0 V and +5 V. As a result, in cases where the signal line voltage and the common voltage have the same polarity, the signal line voltage and the common voltage have a potential difference of 0 V.

Generally, inclusive of the present embodiment, in image displays of pulse width modulation drive, the signal line voltage and the common voltage have zero or very small potential difference in cases where the signal line voltage and the common voltage have the same polarity.

As a result, the charged pixel is discharged in cases where the scan line voltage is in on state and the signal line voltage and the common voltage have the same polarity.

In FIG. 6 of the present embodiment, the on state period extending from timing A6, through timing B6 and timing C6, to timing D6 includes is a period to perform negative polarity wnting.

In that period, the period from timing A6 to timing B6 in FIG. 6 is a period to discharge the charged pixel. From the period from timing A6 to timing B6, the scan line voltage on the n-th scan line is +10 V, indicating that the line is in an on state, and the difference between the signal line voltage and the common voltage is 5 V−(5 V)=0 V. That is, the signal line voltage and the common voltage have the same polarity. As a result, the pixel is discharged with no voltage applied to the pixel on the n-th scan line.

The period from timing B6 to timing D6 in FIG. 6 is a period to charge the pixel to a desired value so that desired tones are effected.

Note that at timing C6 shown in the figure, the signal line voltage changes from +5 V to 0 V. In other words, at timing C6, the scan line voltage of the n-th scan line is +10 V, indicating that the line is in on state, and the difference between the signal line voltage and the common voltage is 0 V−(5 V)=−5 V. Therefore, a voltage of −5 V is applied to the pixels on the n-th scan line, charging the pixels.

As in the foregoing, when the scan line voltage is +10 V, the value of the signal line voltage which is to be applied is 0 V. Further, as shown in FIG. 6, the signal line voltage and the common voltage are both HIGH from timing A6 to timing B6. And, the scan line voltage is in on state, and the pixel is discharged.

The duration of the period from timing A6 to timing B6 is specified so that the pixel discharge ratio is 95% or greater. Accordingly, normally, the duration of the period from timing A6 to timing B6 is specified approximately one to two times that from timing B6 to timing D6.

The discharge ratio is a quantity representing a ratio of the voltage written to a pixel before discharge starts to the voltage written to that pixel during or after the discharge. As the pixel starts to discharge, the voltage written to the pixel gradually decreases, approaching 0.

From timing B6 to timing D6 is a period to charge the pixel; especially, by the signal line voltage inverting at timing C6, the pixel is charged in the period from timing C6 to timing D6. The voltage to which the pixel is charged is controlled by adjusting the period from timing B6 to timing C6 which is a part of the period from timing B6 to timing D6.

The on state period extending from timing E6, through timing F6 and timing G6, to timing H6 in FIG. 6 includes a period to perform positive polarity writing.

In that on state period, the period from timing E6 to timing F6 in FIG. 6 is one to discharge the pixel. In the period from timing E6 to timing F6, the scan line voltage on the (n+1)-th scan line is +15 V, indicating that the line is in on state, the difference between the signal line voltage and the common voltage is 0 V−(0 V)=0 V. As a result, no voltage applied to the pixels on the (n+1)-th scan line, and the pixel is discharged.

The period from timing F6 to timing H6 in FIG. 6 is a period to charge the pixel to a desired value so that desired tones are effected.

The signal line voltage changes from 0 V to +5 V at timing G6 in FIG. 6. In other words, at timing G6, the scan line voltage on the (n+1)-th scan line is +15 V, indicating that the line is in on state, and the difference between the signal line voltage and the common voltage is 5 V−(0 V)=+5 V. Therefore, a voltage of +5 V is applied to the pixels on the (n+1)-th scan line, charging the pixels.

That is, the value of the signal line voltage which is to be applied when the scan line voltage is +15 V is 5 V.

From the foregoing, in the present embodiment, the difference between the scan line voltage and the signal line voltage is +10 V when voltage is applied to pixels.

As in the foregoing, in the present embodiment, when the scan line signal is in on state, the pixel is discharged by causing the signal line voltage and the common voltage to have the same polarity, and thereafter the pixel is charged by inverting the polarity of the signal line voltage.

Further, both when charging occurs on the n-th scan line and when charging occurs on the (n+1)-th scan line, the difference between the scan line voltage and the signal line voltage upon writing is 10 V. As a result, the on-resistance of the TFT, which is a pixel switching element, does not greatly differ between negative polarity writing on the n-th scan line and positive polarity writing on the (n+1)-th scan line.

As a result, when the timing pulses REVD1 to REVDi for the signal line signals are used, no extreme difference needs to be provided between positive polarity writing and negative polarity writing, which makes it possible to deal with the two polarity writings similarly. More specifically, since an optimum opposite voltage varies due to the differing capacitance in the part of the liquid crystal layer, only a difference for compensation with that variation being taken into account, that is, only a difference in timing, needs to be provided.

Besides, thanks to the discharge action, a constant charge ratio can be achieved only by the pulse width regardless of the previous pixel electrode writing voltage. Therefore, desired tones can be written for sure even in, for example, a moving picture display where the voltage written in the previous round of pixel electrode writing often does not represent the same tone as the voltage value desirably written in this round of writing.

Further, as described in the foregoing, the pixel sandwiched between a pixel electrode and a common electrode behaves as a capacitor when a voltage is applied to it. If the voltage value maintained by the capacitor varies, the charge action achieved by applying voltage to the capacitor via a resistor produces different voltage values even when new voltage application is performed for the same duration. Therefore, unless the pixel is charged only after being discharged first as in the foregoing, the actual voltage somewhat differs from the target voltage. In other words, if the pixel is charged only after being discharged as in the method of driving an image display in accordance with the present embodiment, the pixel can be charged producing no offset from the target voltage, and a precise tone display can be carried out.

Embodiment 3

The following will describe another embodiment of the present invention in reference to figures.

A driving device for an image display in accordance with the present embodiment has a similar arrangement to that of the driving device for an image display set forth in embodiment 1. Further, an image display in accordance with the present embodiment has a similar arrangement to that of the image display set forth in embodiment 1. The present embodiment differs from embodiment 1 in timings of temporal changes of the scan line voltage, the signal line voltage, and the common voltage. The following will describe these differences.

Now, the operation of the driving device for an image display in accordance with the present embodiment in the arrangement will be described in reference to figures.

Figure 7:
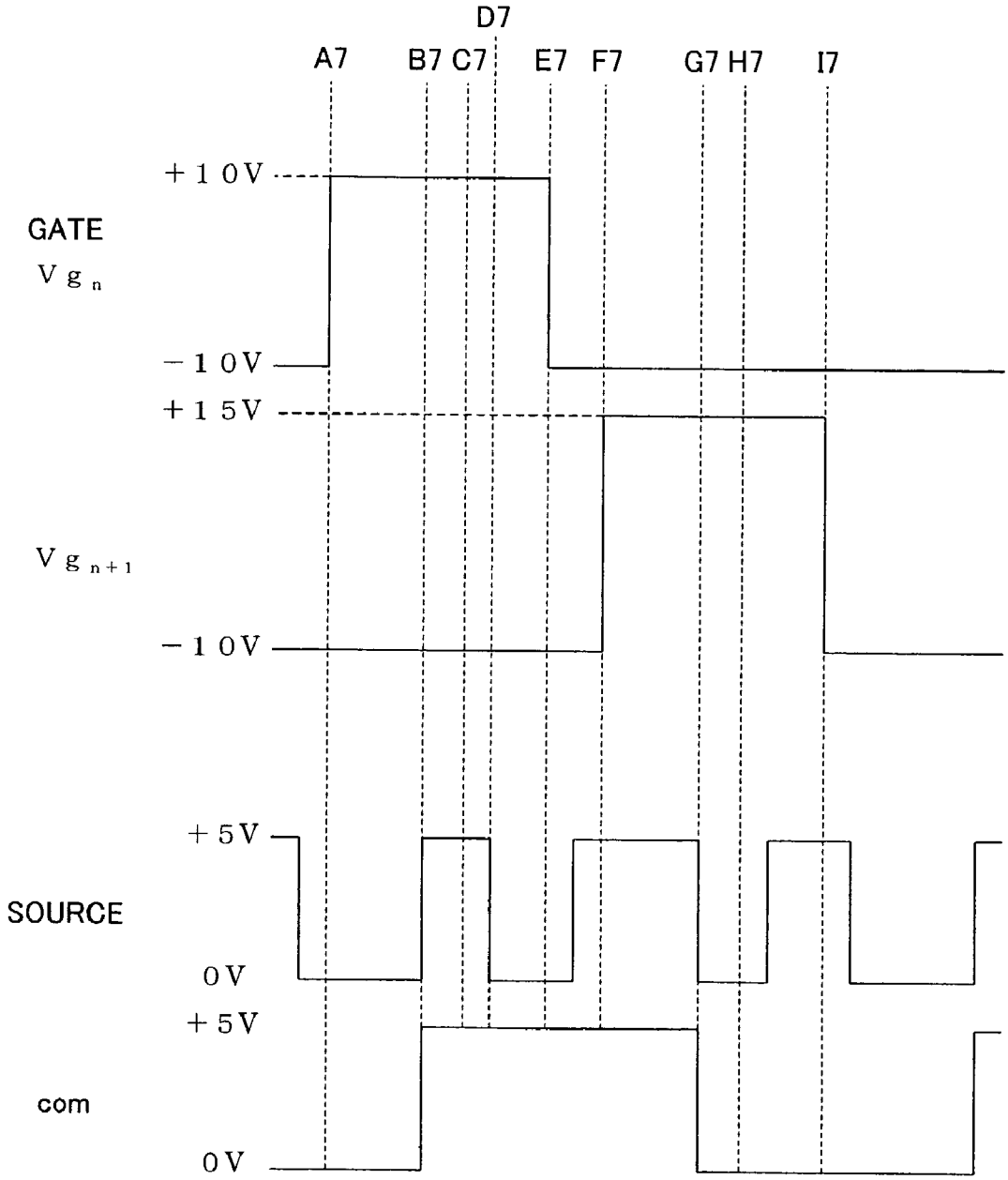
FIG. 7 is a timing chart showing a drive signal in another embodiment of the present invention.

FIG. 7 is a timing chart showing temporal changes of the scan line voltage, the signal line voltage, and the common voltage, where "$Vg_n$" and "$Vg_{n+1}$" indicate scan line voltages applied to the n-th and (n+1)-th scan lines respectively, "source" the signal line voltage, and "com" the common voltage.

As shown in the figure, in the present embodiment, the on state of the scan line voltage is represented by two values: +10 V and +15 V.

In FIG. 7, the on state period extending from timing A7, through timing B7, timing C7, and timing D7, to timing E7 includes a period to perform negative polarity writing.

In the present embodiment, the pixel is discharged in the period from timing A7 to timing C7 which is a part of that period from timing A7 to timing E7. Thereafter, the signal line voltage is inverted in polarity at timing D7 which falls in the period from timing C7 to timing E7 to charge the pixel.

In the present embodiment, at timing B7 in FIG. 7, the signal line voltage and the common voltage are both inverted in polarity. As a result, the signal line voltage and the common voltage have the same polarity before and after timing B7.

Inverting the common voltage in polarity during discharge in this manner have following advantages.

Note that the polarity inversion of the common voltage shown in FIG. 6 above takes place before, for example, timing A6 at which the scan line signal voltage changes to an on-voltage. In this case, the pixel maintains a positive voltage, for example, +4 V, as a result of the previous write action. As a result, when the common voltage is inverted, a voltage change which is equal to the change of the common voltage occurs on the pixel electrode, and the voltage applied to the pixel rises to +9 V. At this time, about 15 V is required as a voltage indicating that the scan line signal is in on state. Further, in this case, the on-resistance characteristic of the transistor may be extremely poor depending on the selection of the voltage indicating that the scan line voltage is in on state.

In contrast, in FIG. 7 of the present embodiment, the common voltage is inverted in polarity (timing B7) during a discharge action as described in the foregoing; therefore, the pixel-charging voltage never rises up to or exceeds the signal line voltage or the common voltage. That is, first, the pixel is discharged to drop the pixel-charging voltage, and the polarity of the common voltage is inverted to the polarity for charging the pixel. As a result, the voltage indicating that the scan line voltage is on can be lowered. That is, in cases where the pixel-charging voltage is high, the switching element can be turned into on state, unless the scan line voltage is HIGH voltage; in the case of the present embodiment, the switching element can be turned into on state without losing a good on-resistance characteristic even if the scan line voltage has a low value. Therefore, the voltage at which the charge ratio required for a tone display is readily controllable is selectable from a wider range as a voltage value indicating on state.

Note that in conventional voltage modulation drive, charging is performed so that the charge ratio is equal to or greater than 99%; the voltage indicating on state to be used makes no difference in driving if the voltage is above a predetermined value. In contrast, in pulse width modulation drive, charging is performed so that the charge ratio reaches about 80% to 90%; the voltage indicating on state can make a difference in driving depending on the selection of the voltage. Accordingly, if a voltage selected which indicates such on state that produces an on-resistance value which achieves a 80% to 90% charge ratio in the period allotted, for example, to pulse width modulation, the charge ratio is controllable more precisely. The on-resistance value in this case is, sufficiently, about twice that in voltage modulation drive.

Further, the on state period extending from timing F7, through timing G7 and timing H7, to timing I7 in FIG. 7 includes is a period to perform positive polarity writing. The pixel is discharged in the period from timing F7 to timing H7 which is a part of the period from timing F7 to timing I7. Thereafter, the signal line voltage is inverted in polarity in the period from timing H7 to timing I7 to charge the pixel. Further, at timing G7, the signal line voltage and the common voltage are both inverted in polarity.

Further, with the arrangement, when the scan line voltage is +10 V, the value of the signal line voltage which is to be applied is 0 V (negative polarity writing). In contrast, when the scan line voltage is +15 V, the value of the signal line voltage to be applied is 5 V (positive polarity writing). Consequently, the difference between the scan line voltage and the signal line voltage when voltage is applied to the pixel is +10 V.

In the embodiment, the operation has been described so far in reference to FIG. 7. This is by no means limiting the present invention. For example, an arrangement may be employed which performs an operation shown in the timing chart in either FIG. 8 or FIG. 9.

Figure 8:
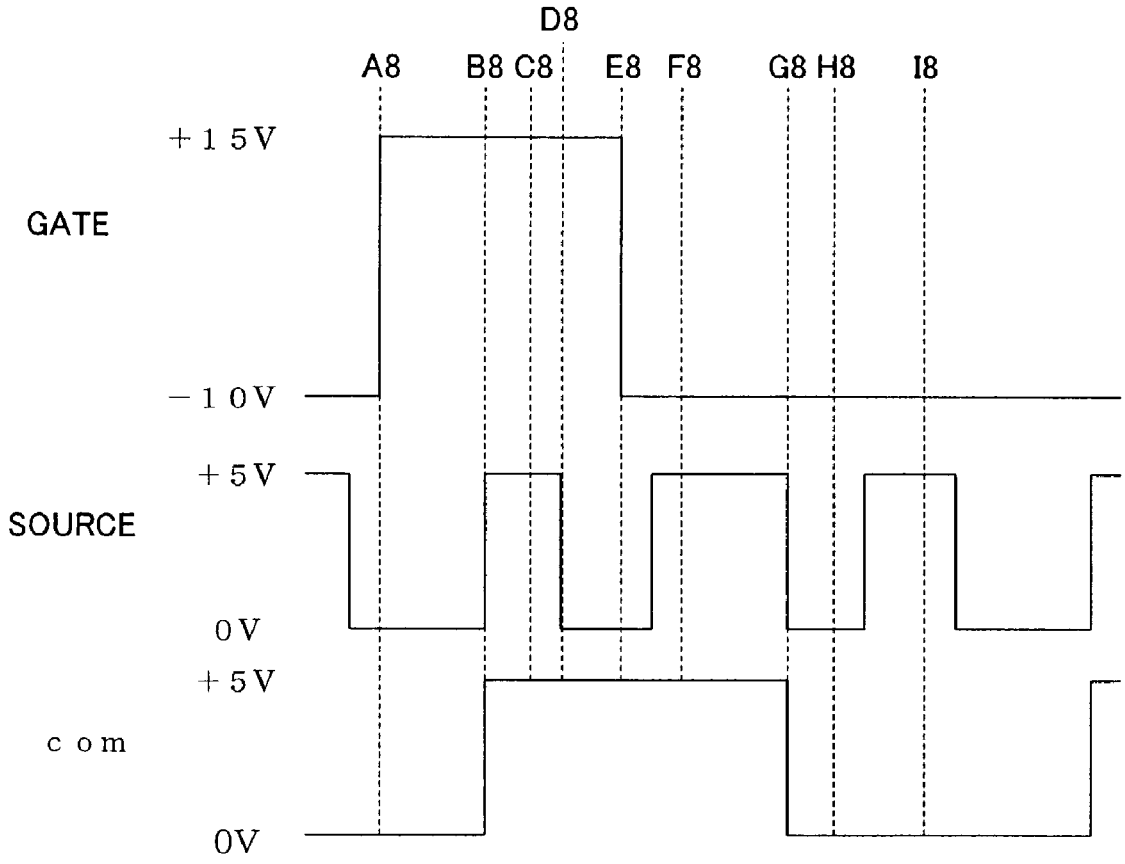
FIG. 8 is a timing chart showing a drive signal in another embodiment of the present invention.

FIG. 8 is a timing chart showing temporal changes of the scan line voltage, the signal line voltage, and the common voltage, where "gate" indicates the scan line voltage applied to the scan line, "source" the signal line voltage, and "com" the common voltage.

As shown in FIG. 8, the pixel is discharged in the period from timing A8 to timing C8 which is a part of the period from timing A8, through timing B8, timing C8, and timing D8, to timing E8. Thereafter, the signal line voltage is inverted in polarity at timing D8 which falls in the period from timing C8 to timing E8, achieving the same effects as in the foregoing. Further, the signal line voltage and the common voltage are simultaneously inverted in polarity at timing B8, achieving the same effects as in the foregoing. Note that the value indicating on state of the scan line voltage may be have one value: +15 V. That is, in the period from timing F8, through timing G8 and timing H8, to timing 18, a scan line voltage (not shown) of +15 V may be applied to the next scan line to make that scan line into on state. Further, the value indicating that the scan line voltage is in on state may be made to differ, and for example, a scan line voltage (not shown) of +20 V may be applied to the next scan line in the period from timing F8 to timing 18 to turn that scan line into on state. In this case, the difference between the scan line voltage and the signal line voltage can be made the same in positive polarity writing and in negative polarity writing.

Figure 9:
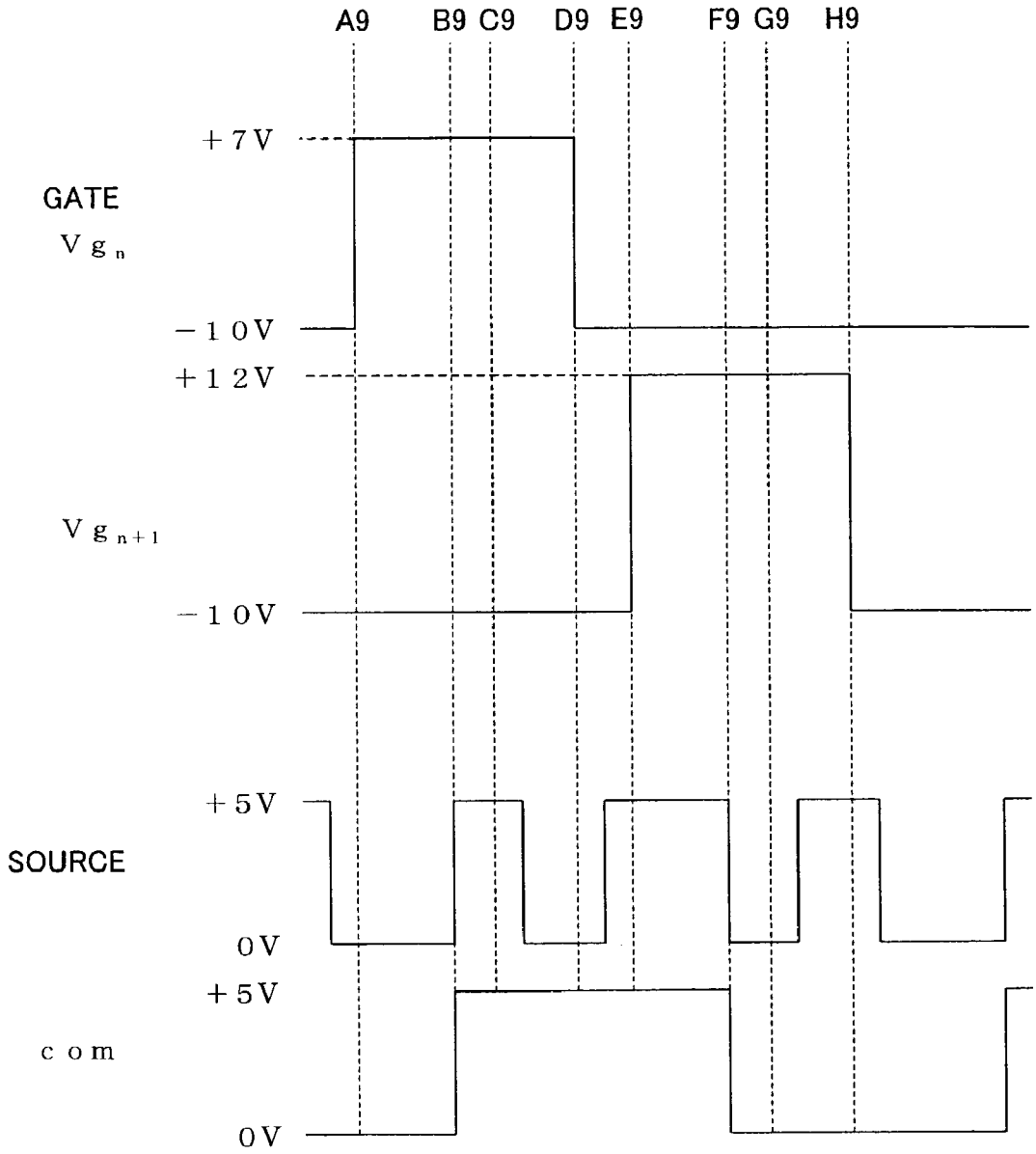
FIG. 9 is a timing chart showing a drive signal in another embodiment of the present invention.

Further, FIG. 9 is similar to FIG. 8. As shown in FIG. 9, the scan line voltage is set to +7 V. The pixel is discharged in the period from timing A9 to timing C9 which is a part of the on state period from timing A9, through timing B9 and timing C9, to timing D9. Thereafter, the signal line voltage is inverted in polarity in the period from timing C9 to timing D9, achieving the same effects as in the foregoing. Further, the signal line voltage and the common voltage are simultaneously inverted in polarity at timing B9, achieving the same effects as in the foregoing. Therefore, as shown in FIG. 9, the voltage indicating that the scan line voltage is in on state can be lowered.

Further, the pixel is discharged in the period from timing E9 to timing G9 which is a part of the on state period from timing E9 in FIG. 9 at which the scan line voltage is changed to +12 V, through timing F9 and timing G9, to timing H9. Thereafter, the signal line voltage is inverted in polarity in the period from timing G9 to timing H9 to charge the pixel.

Further, at timing F9, the signal line voltage and the common voltage are both inverted in polarity. In this manner, the value indicating that the scan line voltage is in on state may have two values: +7 V and +12 V. Further, with the arrangement, when the scan line voltage is +7 V, the value of the signal line voltage which is to be applied is 0 V; in contrast, when the scan line voltage is +12 V, the value of the signal line voltage which is to be applied is 5 V. Consequently, when voltage is applied to the pixel, the difference between the scan line voltage and the signal line voltage is +7 V. Further, one of the two values of the scan line voltage (+7 V) indicating that the scan line is in on state may be less than the summed voltage value of the higher one (+5 V) of the positive signal line voltages and the amplitude (5 V) of the common voltage. This way, power consumption can be further reduced.

That is, by so doing, the voltage indicating that the scan line signal is in on state can be selected and specified from a wider range. For example, an optimum value is selectable which makes it easy for the on-resistance value of the transistor to control the charge ratio. Further, selecting a lowest possible voltage as the voltage indicating that the scan line signal is in on state will reduce power consumption. Besides, operation in specifying various pulse widths for a multi-tone display can be greatly facilitated.

Further, in FIGS. 7-9 described above as examples of the present invention, an arrangement is made such that the common voltage is inverted in polarity at timing B7, B8, or B9 shown in the figures a few microsecond to a few tens of microseconds after the scan line voltage is turned into on state at timing A7, A8, or A9 shown in the figures.

According to the arrangement, the pixel-charging voltage can be restrained from becoming too high upon the polarity inversion of the common voltage. As a result, the voltage indicating that the scan line voltage is in on state can be lowered to such a value at which charging can be controlled easily. Especially in those cases where the on-voltage has two values, the lower on-voltage value is less restricted, and two optimum values for charge control are selectable. A good multi-tone display can be realized.

Embodiment 4

The following will describe another embodiment of the present invention in reference to figures.

A driving device for an image display in accordance with the present embodiment has a similar arrangement to that of the driving device for an image display set forth in embodiment 1. Further, an image display in accordance with the present embodiment has a similar arrangement to that of the image display set forth in embodiment 1. The present embodiment differs from embodiment 1 in timings of temporal changes of the scan line voltage, the signal line voltage, and the common voltage. The following will describe these differences.

Now, the operation of the driving device for an image display in accordance with the present embodiment in the arrangement will be described in reference to figures.

Figure 10:
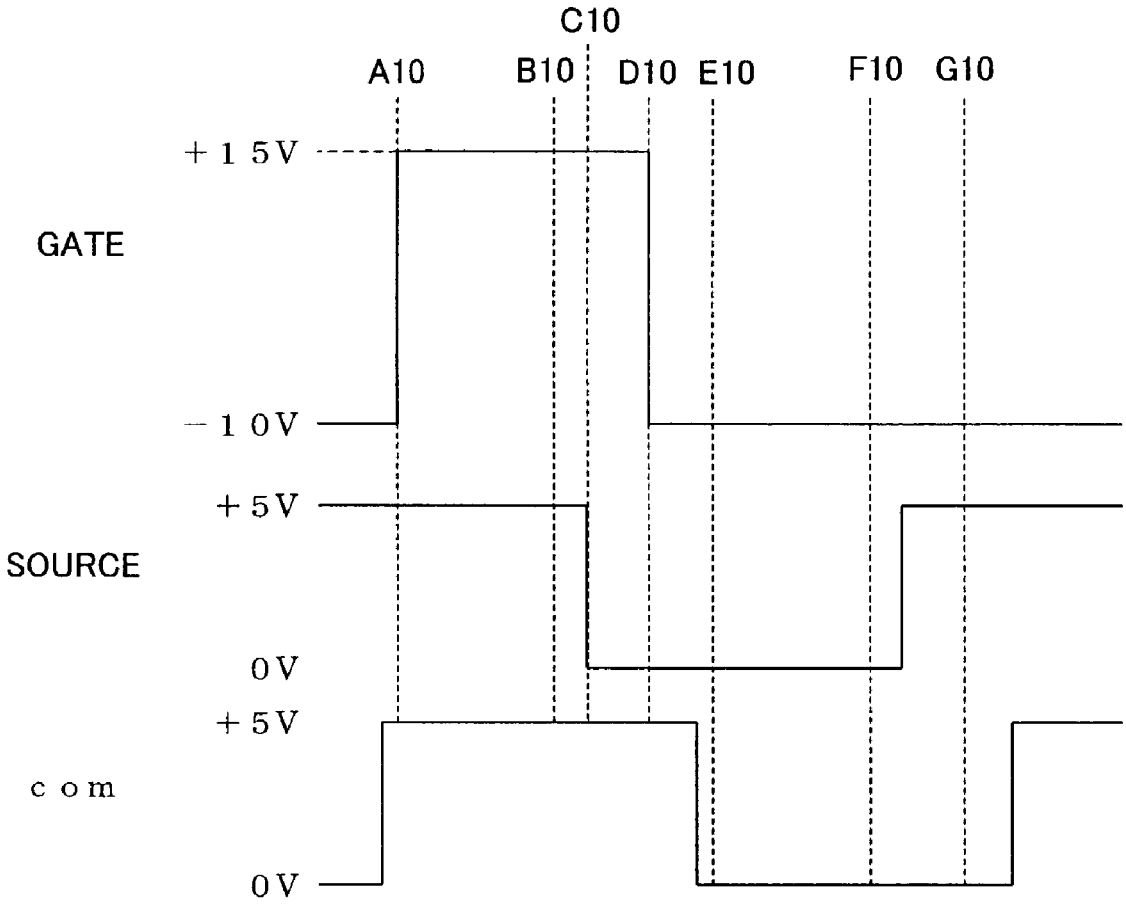
FIG. 10 is a timing chart showing a drive signal in another embodiment of the present invention.

FIG. 10 is a timing chart showing temporal changes of the scan line voltage, the signal line voltage, and the common voltage, where "gate" indicates the scan line voltage, "source" the signal line voltage, and "com" the common voltage. In the present embodiment, the on state of the scan line voltage is represented by one value: +15 V.

The on state period from timing A10, through timing B10 and timing C10, to timing D10 in FIG. 10 includes a period to perform negative polarity writing.

In the present embodiment, the pixel is discharged from timing A10 to timing B10 which is a part of the period from timing A10 to timing D10. Thereafter, the signal line voltage is inverted in polarity at timing C10 which falls in the period from timing B10 to timing D10 to charge the pixel.

A10 in the figure indicates the timing for the scan line voltage to change to on state.

As shown in the figure, at timing A10, the signal line voltage is HIGH, and so is the common voltage. The signal line voltage and the common voltage have the same polarity.

Note that in the present embodiment, since the signal line voltage has two values, 0 V or +5 V, and the common voltage has two values, 0 V or +5 V, when the signal line voltage and the common voltage has the same polarity, the potential difference between the signal line voltage and the common voltage is 0 V.

That is, at and after timing A10 when the potential difference between the signal line voltage and the common voltage becomes 0 V, the pixel releases the charge.

Further, in the present embodiment, the period from timing A10 to timing B10 in which the pixel is discharged, the pixel discharge ratio is specified to 95% or more. As a result of the specification, the period from timing A10 to timing B10 is normally specified approximately one to two times the period from timing B10 to timing C10 as in the present embodiment.

Note that at least such a duration that tone voltage can be controlled in pulse width modulation drive is allotted to the duration from timing B10 to timing C10. The duration is typically such a duration that the charge ratio is approximately 80% to 95%. When this is the case, charging and discharging share the same time constant; a duration about one to two times that from timing B10 to timing C10 is needed to discharge the pixel 95% or more. That is, specifying the duration from timing A10 to timing B10 as in the foregoing achieves 95% or more discharging.

Further, timing C10 in FIG. 10 is a timing when the signal line voltage is changed to the opposite polarity while keeping the scan line voltage in on state. That is, at timing C10 the signal line voltage is changed to the opposite polarity, i.e., from HIGH to LOW, At timing C10, the signal line voltage is 0 V, the common voltage is +5 V, and the potential difference between the signal line voltage and the common voltage is −5 V. As in the foregoing, since the scan line voltage is in on state at C10, voltage is applied to, and charges, the pixel at and after timing C10 when the potential difference between the signal line voltage and the common voltage becomes −5 V.

As in the foregoing, the driving device for an image display in accordance with the present embodiment is arranged so as to make the signal line voltage and the common voltage have the same polarity while the scan line voltage is being in on state so that the pixel is discharged and thereafter invert the signal line voltage while the scan line voltage is being kept in on state so that the pixel is charged.

Therefore, the pixel is discharged before being charged. Regardless of the previous charge quantity, the pixel charge quantity can be more precisely controlled and tones can be more precisely displayed.

That is, as described in the foregoing, the pixel sandwiched between a pixel electrode and a common electrode behaves as a capacitor when voltage is applied to it. If the voltage value maintained by the capacitor varies, the charge action achieved by applying voltage to the capacitor via a resistor produces different voltage values even when new voltage application is performed for the same duration. Therefore, unless the pixel is charged only after being discharged first as in the foregoing, the actual voltage somewhat differs from the target voltage. In other words, if the pixel is charged only after being discharged as in the method of driving an image display in accordance with the present embodiment, the pixel can be charged producing no offset from the target voltage, and a precise tone display can be carried out.

Further, according to the arrangement, the pixel is discharged first before being charged for every round of writing. In moving picture and other like cases where the display tone changes for every round of writing, the image can be more precisely displayed.

Moreover, in the present embodiment, when the scan line voltage is turned into on state, the signal line voltage and the common voltage have the same polarity. Therefore, wasteful charging is prevented: for example, it is prevented that the signal line voltage and the common voltage have opposite polarity when the scan line voltage is turned into on state and later made to have the same polarity to discharge the pixels.

The embodiment above has dealt with a case where the value indicating that the scan line voltage is in on state has one value. However, the present invention is by no means limited to that case. The value indicating that the scan line voltage is in on state may take two or more values.

Note that the value indicating that the scan line voltage is in on state which has one value means that a scan line voltage (not shown) of +15 V is applied to the next scan line to turn that scan line into on state, for example, in the period from timing E10 through timing F10 to timing G10 shown in FIG. 10. When this is the case, the pixel is discharged in the period from timing E10 to timing F10 and charged in the period from timing F10 to timing G10. Further, the value indicating that the scan line voltage is in on state may be made to differ, and for example, a scan line voltage (not shown) of +20 V may be applied to the next scan line in the period from timing E10 to timing G10 to turn that scan line into on state. In this case, the difference between the scan line voltage and the signal line voltage can be made the same in positive polarity writing and in negative polarity writing.

Embodiment 5

The following will describe another embodiment of the present invention in reference to figures.

A driving device for an image display in accordance with the present embodiment has a similar arrangement to that of the driving device for an image display set forth in embodiment 1. Further, an image display in accordance with the present embodiment has a similar arrangement to that of the image display set forth in embodiment 1. The present embodiment differs from embodiment 1 in timings of temporal changes of the scan line voltage, the signal line voltage, and the common voltage. The following will describe these differences.

Now, the operation of the driving device for an image display in accordance with the present embodiment in the arrangement will be described in reference to figures.

Figure 11:
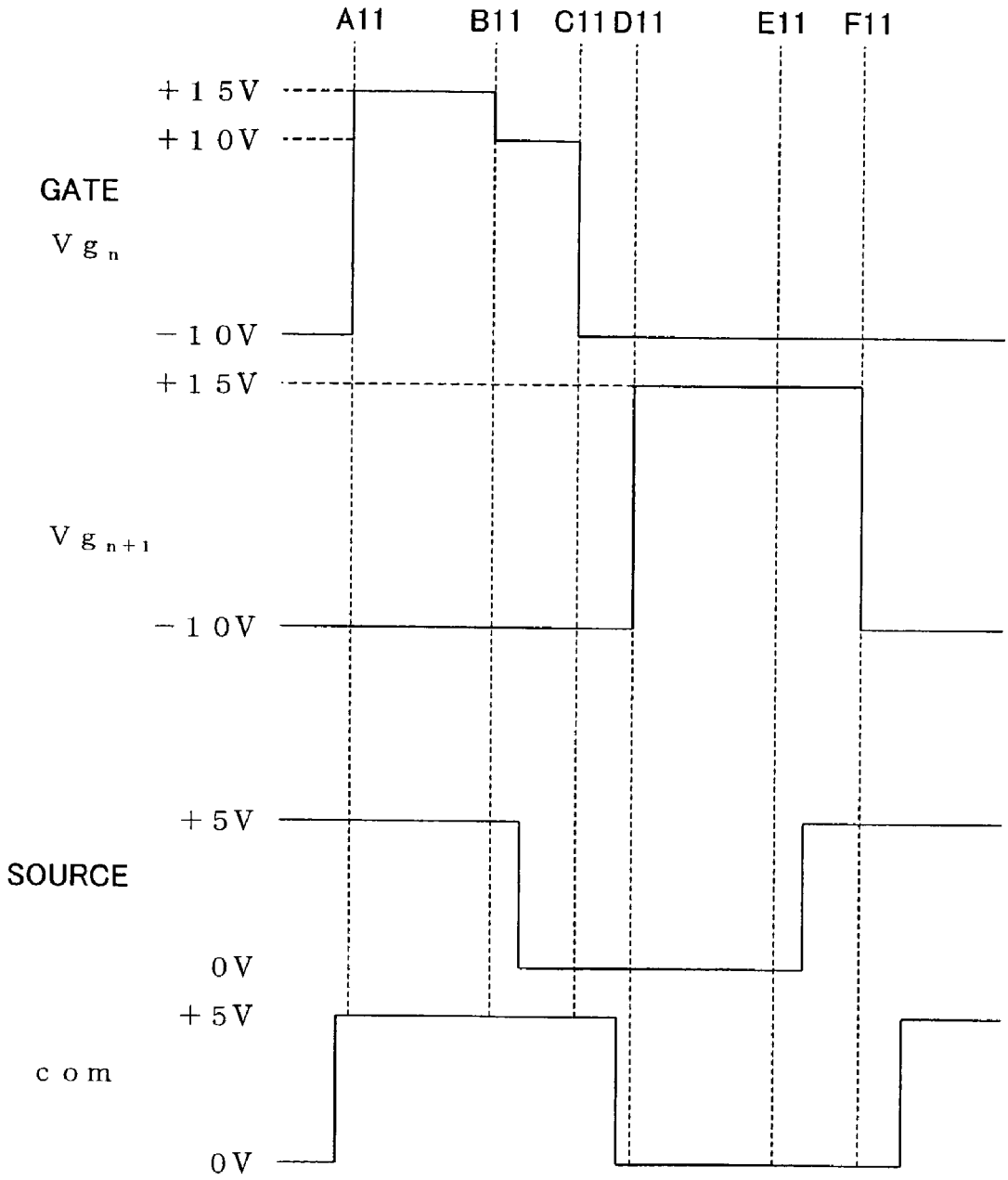
FIG. 11 is a timing chart showing a drive signal in another embodiment of the present invention.

FIG. 11 is a timing chart showing temporal changes of the scan line voltage, the signal line voltage, and the common voltage, where "$Vg_n$" and "$Vg_{n+1}$" indicate scan line voltages applied to the n-th and (n+1)-th scan lines respectively, "source" the signal line voltage, and "corn" the common voltage.

The on state period from timing A11 through timing B11 to timing C11 in FIG. 11 includes a period to perform negative polarity writing.

In the present embodiment, the pixel is discharged in the period from timing A11 to timing B11 which is a part of that period from timing A11 to timing C11. Thereafter, the signal line voltage is inverted in polarity in the period from timing B11 to timing C11 to charge the pixel.

Note that the discharge action in the period from timing A11 to timing B11 does not restrict other actions and is convenient if the action is completed in a shortest possible time.

In the present embodiment, the voltage indicating that the scan line voltage is in on state has two values: 15 V and 10 V. The higher voltage, 15 V, is used to indicate on state in the discharge period from timing All to timing B11. As a result, the time required for the discharge action can be shortened in comparison to cases where, for example, the lower voltage is used. Further, the lower voltage, 10 V, is used to indicate on state in the charge period from timing B11 to timing C11.

Further, the pixel is discharged in the period from timing D11 to timing E11 which is a part of the on state period from timing D11 through timing E11 to timing F11 shown in FIG. 11 throughout which the scan line voltage is set to +15 V. Thereafter, the signal line voltage is inverted in polarity in the period from timing E11 to timing F11 to charge the pixel.

Further, with the arrangement, the signal line voltage value to be applied is 0 V between timing B11 and timing C11 when the scan line voltage is +10 V; in contrast, the signal line voltage value to be applied is 5 V later between timing E11 and timing F11 when the scan line voltage is +15 V. Consequently, the difference between the scan line voltage and the signal line voltage is +10 V when voltage is applied to the pixel.

Further, the present embodiment is not limited to the arrangement shown in FIG. 11. An arrangement, like the one in FIG. 12, is also possible.

Figure 12:
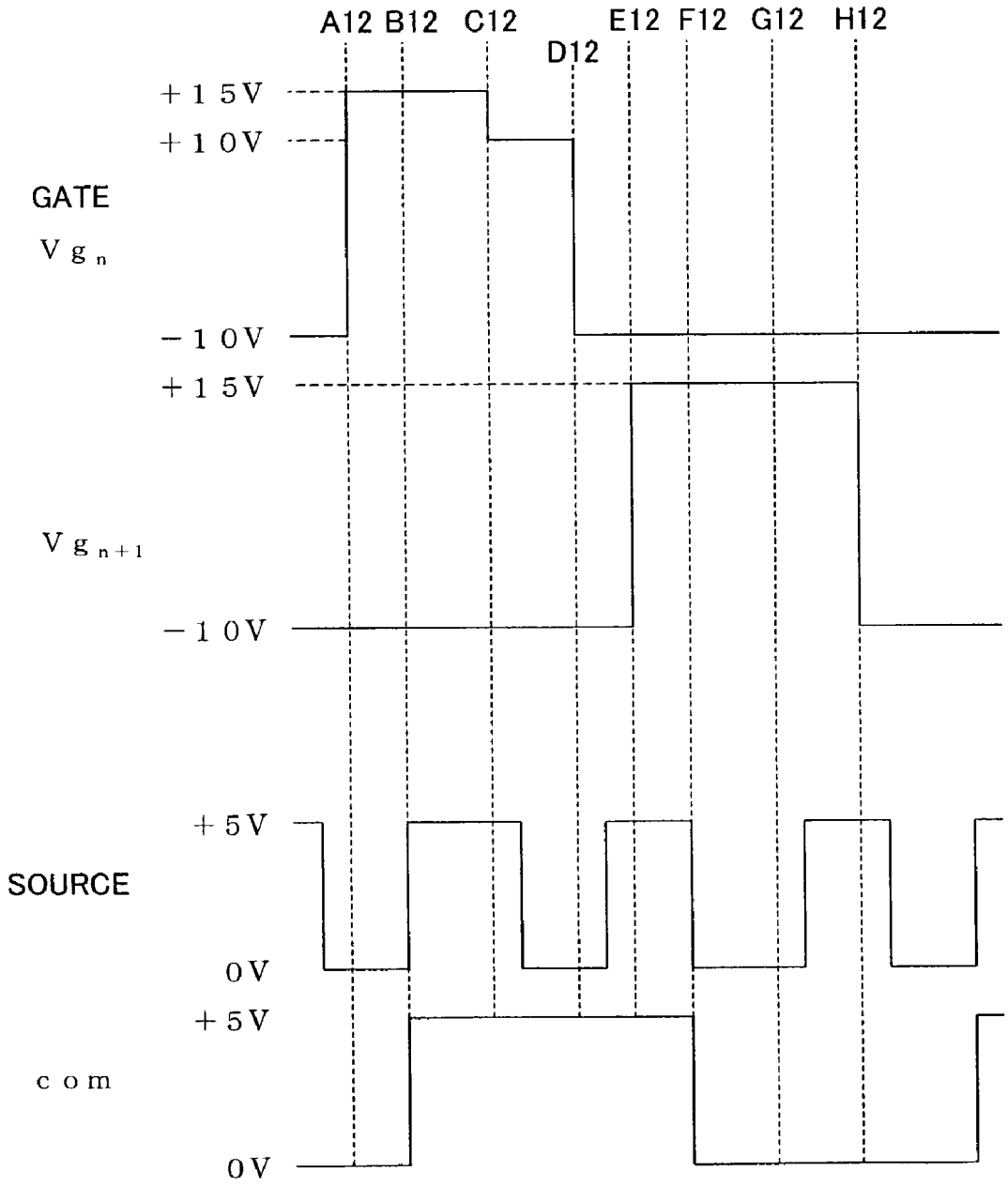
FIG. 12 is a timing chart showing a drive signal in another embodiment of the present invention.

The on state period from timing A12 through timing B12 and timing C12 to timing D12 shown in FIG. 12 includes a period to perform negative polarity writing In the present embodiment, the pixel is discharged in the period timing A12 to timing C12 which is a part of the on state period from timing A12 to timing D12. Thereafter, the signal line voltage is inverted in polarity in the period from timing C12 to timing D12 to charge the pixel. Further, the signal line voltage and the common voltage are both inverted in polarity at timing B12 which falls in the discharge period from timing A12 to timing C12.

Note that an arrangement is possible in which as shown in FIG. 12, the higher one (15 V) of the two values, 15 V and 10 V, is used as the voltage indicating on state in the discharge period from timing A12 to timing C12. With the arrangement, the time required for the discharge action can be shortened in comparison to cases where, for example, the lower voltage is used. Further, the lower voltage, 10 V, may be used to indicate on state in the charge period from timing C12 to timing D12.

When this is the case, both the signal line voltage and the common voltage may be inverted again in polarity at timing B12 so that the voltage used for on state of the scan line voltage can be selected from a wider range. That is, the voltage used for on state of the scan line voltage can be selected so as to make charge control easier.

Further, the pixel is discharged in the period from timing E12 to timing G12 which is a part of the on state period from timing E12 through timing F12 and timing G12 to timing H12 shown in FIG. 12 in which the scan line voltage is +15 V. Thereafter, the signal line voltage is inverted in polarity in the period from timing G12 to timing H12 to charge the pixel. Further, at timing F12, the signal line voltage and the common voltage are both inverted in polarity.

Incidentally, with the arrangement, the signal line voltage value to be applied is 0 V between timing C12 and timing D12 when the scan line voltage is +10 V; in contrast, the signal line voltage value to be applied is 5 V later between timing G12 and timing H12 when the scan line voltage is +15 V. Consequently, the difference between the scan line voltage and the signal line voltage is +10 V when voltage applied to the pixel.

Embodiment 6

The following will describe another embodiment of the present invention in reference to figures.

A driving device for an image display in accordance with the present embodiment has a similar arrangement to that of the driving device for an image display set forth in embodiment 1. Further, an image display in accordance with the present embodiment has a similar arrangement to that of the image display set forth in embodiment 1. The present embodiment employs the arrangement described in embodiment 1 regarding drive timings.

Meanwhile, the present embodiment employs the following pixel charging method based on embodiment 1. Accordingly, the following will describe these differences in reference to figures.

The present embodiment employs drive timings as show in FIG. 5 which were described in embodiment 1.

That is, in positive polarity writing in period A' in FIG. 5, the difference between the signal line voltage and the common voltage, 5 V−(0 V)=5 V, is applied to the pixel.

Note that in the present embodiment, a maximum value of a pixel attained voltage is specified between 4 V and 4.5 V in the arrangement. When the maximum value of the pixel attained voltage, i.e., the maximum value of the voltage written to the pixel electrode is set to 4 V, the value is 80% of the voltage (5 V) supplied to the signal line.

That is, in positive polarity writing, the attained ratio of the maximum value of the voltage written to the pixel electrode to the voltage supplied to the signal line is 80%.

Further, in negative polarity writing in period B' shown in FIG. 5, the difference between the signal line voltage and the common voltage, −5 V−(0 V)=−5 V, is applied to the pixel.

Note that in the present embodiment, the maximum value of the pixel attained voltage is specified approximately to −4 V to −4.5 V in the arrangement. When the maximum value of the pixel attained voltage, i.e., the maximum value of the voltage written to the pixel electrode, is specified approximately to −4 V, the value is about 80% of the voltage (−5 V) supplied to the signal line.

That is, in negative polarity writing, the attained ratio of the maximum value of the voltage written to the pixel electrode to the voltage supplied to the signal line is about 80%, and is different from the ratio in positive polarity writing for following reasons.

Figure 16:
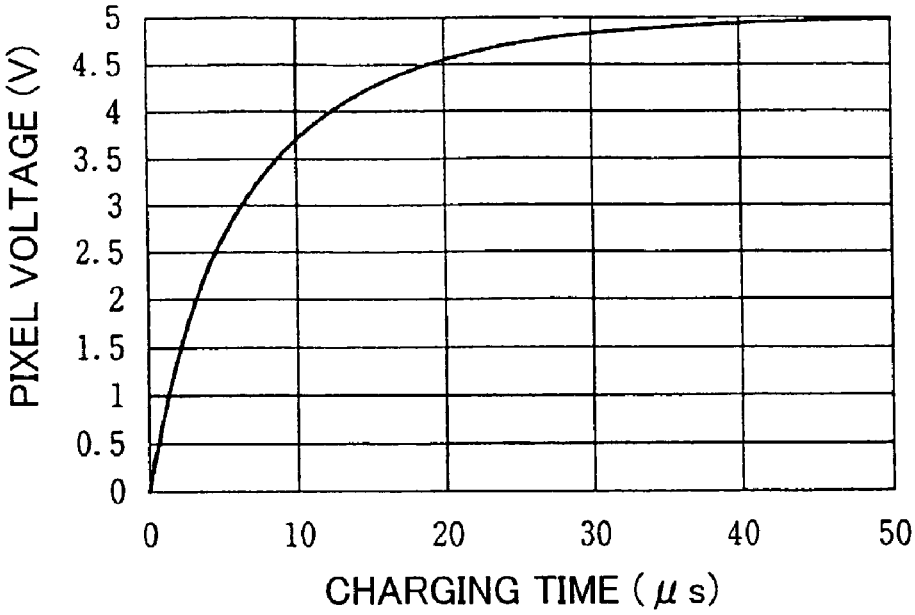
FIG. 16 is a graphical representation of pixel voltages in driving.

First, temporal changes of the attained voltage (pixel voltage) of the pixel in positive polarity writing in a case where 5 V is supplied to the signal line are shown in FIG. 16. Further, temporal changes of the pixel voltage in negative polarity writing in a case where −5 V is supplied to the signal line is shown in FIG. 17.

Figure 17:
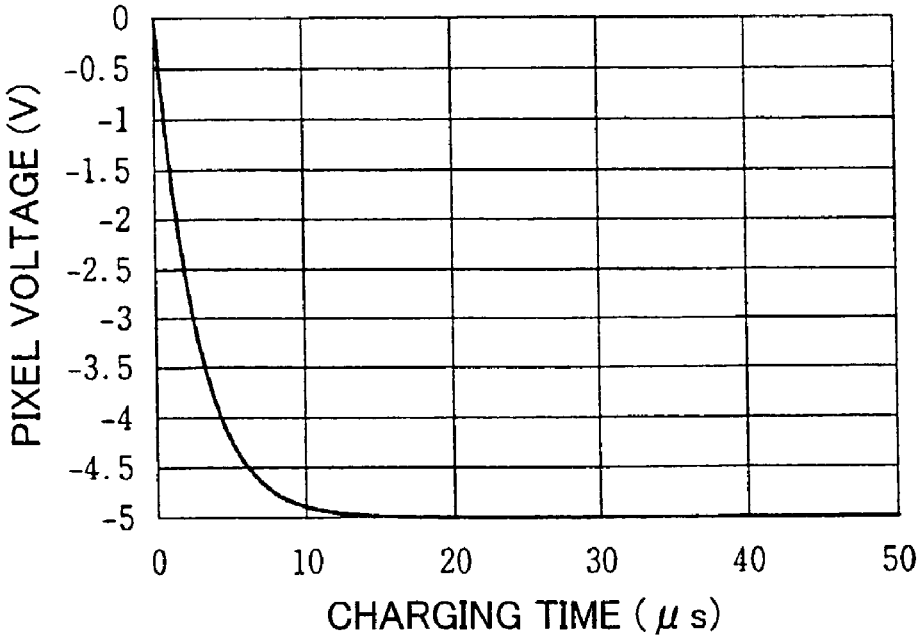
FIG. 17 is a graphical representation of pixel voltages in driving.

As shown in FIG. 16, in positive polarity writing, for example, 4 V is reached in about 12 microseconds; in contrast, as shown in FIG. 17, in negative polarity writing, for example, 4 V is reached in about 5 microseconds.

This illustrates that if the TFT is used as the pixel switching element, positive polarity writing and negative polarity writing have different TFT-based pixel charging characteristics.

Note that if, for example, the attained ratio in negative polarity writing is made to suitably differ from that in positive polarity writing as described in the foregoing, the charging characteristics in positive polarity writing and that in negative polarity writing can be made closer to each other in the following sense. For example, if the maximum value of the attained voltage in negative polarity writing is raised somewhat from 4 V to about 4 V, the time taken to charge the pixel up to the about 4 V level increases.

This sufficiently increases the time to charge the pixel to the maximum value of the attained voltage in positive polarity writing and in negative polarity writing.

Therefore, time width control required for a tone display in writing can be facilitated. Therefore, a panel can be offered which achieves a more stable display state and which is more stable against the occurrence of a signal delay and an irregular transistor characteristic.

Further, the frequency of the reference clock required to produce a signal with a desired pulse width in a signal line driver can be lowered, which restrains power consumption to a low level.

Further, as described in the foregoing, in the present embodiment, in positive polarity writing, the maximum value of the attained voltage of the pixel is 80% of the voltage supplied to the signal line. Further, in negative polarity writing, the maximum value of the attained voltage of the pixel is about 80% of the voltage supplied to the signal line. Thus, the maximum value of the amplitude of the voltage written to the pixel electrode is about 80% of the amplitude of the voltage supplied to the signal line.

Therefore, the pixel can be charged efficiently as will be described in the following.

As can be seen from FIG. 16, the curve is already satisfactorily straight when the pixel voltage is 4 V. Therefore, using only a charge ratio lower than this is not very effective in yielding linearity.

In contrast, as is clear from FIG. 16 to the right of the 30 microsecond line, at charge ratios over 98%, the pixel voltage increases only by negligible amounts compared to the charge time. Therefore, the linearity of charging characteristics can be improved by chopping off this region of small change ratios.

This is also the case with negative polarity writing shown in FIG. 17.

In this manner, the maximum value of the amplitude of the voltage written to the pixel electrode can be adapted to not less than 80% and not more than 98% of the amplitude of the voltage supplied to the signal line. Taking FIG. 16 as an example, this corresponds to the utilization of a section of the charge curve which is between the 0 microsecond charge time and 12 microsecond (equivalent to 80%) to 30 microsecond (equivalent to 98%) charge time.

Further, the aforementioned embodiment has dealt, for simplicity, with the arrangement described in embodiment 1 in reference to FIG. 5, but the present embodiment is not limited to that arrangement.

For example, in the aforementioned arrangement, the DC common voltage was 0 V and was used as a reference. The common voltage may be the one in FIG. 1: for example, an AC voltage. When this is the case, the aforementioned relationship between the maximum value of the pixel attained voltage and the voltage supplied to the signal line may be safely regarded as the relationship between the pixel potential before the start of charging and the signal line potential during charge.

Strictly, the charging characteristics in such a case differs from those shown in FIG. 16 and FIG. 17 which depict charging which starts at 0 V. In all the cases, however, the phenomenon is manifested that the pixel voltage increases only by negligible amounts compared to the charge time at charge ratios over 98%.

Further, the aforementioned arrangement of the present embodiment is not limited to embodiment 1, but may be combined with embodiments 2 to 5. That is, any of the arrangements shown in FIGS. 6-12 described in embodiments 2-5 can be used for drive timings and drive voltages.

Further, the aforementioned arrangement may be expressed as in the following.

In the charging characteristics shown in FIG. 16 and FIG. 17, the attained ratio is made to suitably differ in positive polarity writing and negative polarity writing as described in the foregoing. This makes pulse width A' in positive polarity writing differ from pulse width B' in negative polarity writing, both widths being shown in FIG. 5.

As in the foregoing, the method of driving an image display in accordance with the present embodiment may be arranged to produce different pulse widths so as to obtain desired charge voltages corresponding to respective desired tones.

Further, in the arrangement, the method of driving an image display in accordance with the present embodiment may be arranged so that: the voltage supplied to the signal line has two values; tones are displayed on the basis of the pulse width of the voltage; and the amplitude of the voltage supplied to the scan line is made to differ in positive polarity writing and negative polarity writing.

Note that when, for example, pulse width modulation drive is performed based on TFTs as pixel switching elements, since pixel charging is interrupted part way to produce tones, the on-resistances of the transistors at the initial stage of writing are preferably made equal to each other in any event in view of better tone reproducibility. However, the TFT is a three terminal element and the on-resistance varies due to the relationship of potentials of the elements.

In contrast, in the aforementioned arrangement, if the amplitude of the voltage supplied to the scan line is appropriately altered in positive polarity writing and in negative polarity writing, the on-resistances of the transistors can be made equal to each other, and differences in write performance can be lowered. Thus, even if TFTs, which are three terminal elements, are used, the on-resistances of the transistors at the initial stage of writing can be made equal to each other, and good tone reproducibility can be achieved. Therefore, in pulse width modulation drive, a good multitone display can be realized while restraining power consumption.

Further, by carrying out the method of driving an image display described in the foregoing with a driving device for an image display device, the driving device for an image display in accordance with the present invention can be realized, and an image display device in accordance with the present invention can be realized.

In the aforementioned embodiment, the difference between the scan line voltage and the signal line voltage was assumed to be equal in positive polarity writing and in negative polarity writing. "Equal" here does not need to be interpreted strictly. The present invention is also applicable to arrangements in which the difference between the scan line voltage and the signal line voltage is sufficiently equal in positive polarity writing and in negative polarity writing. Such arrangements can also decrease the difference in timing in positive polarity writing and negative polarity writing compared to conventional cases as mentioned in the foregoing. The cases include those in which the difference is intended to be equal, but turns out otherwise.

As in the foregoing, an image display in accordance with the present invention includes: transistors having drains connected to pixels; and a voltage driving section which applies a scan line voltage to gates of the transistors through scan lines, applies a signal line voltage to sources of the transistors through signal lines and supplies a common voltage to a common electrode to apply a voltage to the pixels between the drains of the transistors and the common electrode. The voltage driving section applies a scan line voltage to a scan line so as to switch the transistor between on state and off state. When the transistor is in on state, the difference between the signal line voltage and the common voltage is applied to the pixel. The voltage driving section controls the scan line voltage, the signal line voltage, and the common voltage so that the difference between the signal line voltage and the common voltage applied to the pixel when the transistor is in on state is AC. Further, by adjusting the pulse width of the difference between the signal line voltage and the common voltage when the transistor is in on state, the pixel charge quantity is adjusted and display tones are controlled. The voltage driving section then makes the same the difference between the scan line voltage and the signal line voltage applied to the pixel in cases where the difference between the signal line voltage and the common voltage is positive and in those where the difference is negative, when the transistor is in on state.

That is, the image display is arranged to make the difference between the scan line voltage and the signal line voltage the same in positive polarity writing and in negative polarity writing of AC driving of the pixels in pulse width modulation drive used as a drive method.

As a result, the on-resistance of the transistor as a switching element can be made the same in positive polarity writing and negative polarity writing. Consequently, no high frequency clock is required to produce subtle differences of charge ratio in the writing of voltage to pixels. Power consumption which depends on the clock frequency can be reduced too.

Further, an image display in accordance with the present invention, as in the foregoing, is arranged in pulse width modulation drive so as to, when the scan line voltage is in on state, make the signal line voltage and the common voltage equal to each other to discharge the pixels, and the signal line voltage is thereafter changed to charge pixels.

Therefore, the pixels are discharged before being charged. Regardless of the previous charge quantity, the pixel charge quantity can be more precisely controlled and tones can be more precisely displayed.

Further, in this arrangement, the signal line voltage and the common voltage may be changed simultaneously while the signal line voltage and the common voltage are being made equal to each other to discharge the pixels. If polarity inversion takes place during a discharge action in this manner, the voltage indicating that the scan line signal is on can be lowered.

That is, when the pixel is to be charged, the scan line voltage by which the transistor turns into on state is determined in accordance with the pixel-charging voltage. That is, when the pixel-charging voltage is high, a high voltage is required as the scan line voltage by which the transistor is turned into on state. Further, the scan line voltage by which the transistor is turned into on state depends also on the voltage applied to the pixel by the common electrode. That is, when the voltage applied to the pixel by the common electrode is high, a high voltage is required as the scan line voltage by which the transistor is turned into on state.

Accordingly, before the common voltage is changed to charge the pixel, the scan line voltage is turned into on state. The pixel is then discharged to lower the voltage build-up in the pixel. Thereafter, the polarity of the common voltage is inverted to the polarity at which the pixel is charged, and the pixel is charged. Thus, the voltage value of the scan line voltage indicating on state may be selected from a wider range.

Further, in this arrangement, the scan line voltage have two values representing on state: one of the two values of the scan line voltage indicating on state may be less than a sum of a higher positive polarity value of the signal line voltage and an amplitude of the common voltage.

Further, in this arrangement, the scan line voltage have two values representing the on state, and the signal line voltage and the common voltage may be made equal to each other to discharge the pixel when on state, while a higher value of the scan line voltage is being applied.

Further, as in the foregoing, a method of driving an image display in accordance with the present invention, in the arrangement, may be arranged so that the scan line voltage is such that a voltage indicative of on state in positive polarity writing differs from a voltage indicative of on state—in negative polarity writing, so as to make the difference between the scan line voltage and the signal line voltage in positive polarity writing and negative polarity writing of the AC driving.

According to the arrangement, for example, a higher voltage of the two signal line voltages can be applied to perform positive polarity writing during a period when a higher voltage of the two voltage values indicating that on state of the scan line voltage is being applied, and a lower voltage of the two signal line voltages can be applied to perform negative polarity writing during a period when a lower voltage of the two voltage values indicating on state of the scan line voltage is being applied. That is, the difference between the scan line voltage and the signal line voltage can be most easily made the same in positive polarity writing and in negative polarity writing of AC driving.

Further, a method of driving an image display in accordance with the present invention, in the arrangement, may be arranged so that the signal line voltage and the common voltage for those pixels which are connected to the on-state pixel switching elements are made equal to each other to discharge those pixels and the signal line voltage is changed to charge them.

According to the arrangement, the signal line voltage and the common voltage are caused to have the same polarity, while the scan line voltage is in on state, so as to discharge the pixels. Thereafter, while the scan line voltage is still being in on state, the polarity of the signal line voltage is inverted to charge the pixels.

Therefore, the pixels first release the charge accumulated in the previous round of writing, before they are charged in this round of writing. The pixel charge quantity can be more precisely controlled and tones can be more precisely displayed, regardless of the previous charge quantity.

Note that the pixels sandwiched between the pixel electrodes and the common electrode behave as capacitors when voltage is applied to them. If the voltage value maintained by the capacitor varies, the charge action achieved by applying voltage to the capacitor via a resistor produces different voltage values even when new voltage application is performed for the same duration. Therefore, unless the pixels are charged only after being discharged first as in the foregoing, the actual voltage somewhat differs from the target voltage. In other words, if the pixels are charged only after being discharged as in the method of driving an image display in accordance with the present invention, the pixels can be charged producing no offset from the target voltage, and a precise tone display can be carried out.

Further, according to the arrangement, since the pixels are discharged first before being charged for every round of writing, in moving picture and other like cases where the display tone changes for every round of writing, the image can be more precisely displayed.

Further, in the arrangement, it is also preferred if when the scan line voltage is to be turned into on state, the signal line voltage and the common voltage have the same polarity. According to this arrangement, wasteful charging is prevented: for example, it is prevented that the signal line voltage and the common voltage have opposite polarity when the scan line voltage is turned into on state and later made to have the same polarity to discharge the pixels.

Further, a method of driving an image display in accordance with the present invention, in the arrangement, may be arranged so that the signal line voltage and the common voltage for those pixels which are connected to the on-state pixel switching elements are made equal to each other to discharge those pixels and the signal line voltage and the common voltage are simultaneously changed.

According to the arrangement, the common voltage is inverted in polarity during a discharge action; therefore, the pixel-charging voltage never rises up to or exceeding the signal line voltage or the common voltage. As a result, the voltage indicating that the scan line signal is on can be lowered.

That is, by so doing, the voltage indicating that the scan line signal is on can be selected and specified from a wider range. For example, an optimum value is selectable which makes it easy for the on-resistance value of the transistor to control the charge ratio. Further, selecting a lowest possible voltage as the voltage indicating that the scan line signal is on will reduce power consumption. Besides, operation in specifying various pulse widths for a multi-tone display can be greatly facilitated.

Further, a method of driving an image display in accordance with the present invention, in the arrangement, may be arranged so that an attained ratio of a maximum value of a voltage written charging the pixel electrodes to a voltage supplied to the signal line differs in the positive polarity writing and the negative polarity writing.

In the arrangement, if the attained ratio of a maximum value of a voltage written to the pixel electrodes to a voltage supplied to the signal line suitably differs in positive polarity writing and negative polarity writing, the time constant of the pixel can be specified to a great value. As a result, the charging characteristics can be made gradual both in the positive and negative directions and a time control width in a tone display can be increased, thus obtaining a stable display state. Namely, it is possible to provide a panel with improved stability against signal delays or non-uniformity in transistor characteristics.

Further, a method of driving an image display in accordance with the present invention, in the arrangement, may be arranged so that a pulse width of a voltage supplied to the signal line in a conduction period of the pixel switching elements for a display of an identical tone differs in the positive polarity writing and the negative polarity writing.

As described in the foregoing, when transistor are used as pixel switching elements, charging characteristics vary depending on the writing voltage polarity. Accordingly, as in the arrangement, desired charge voltages are obtainable regardless of the differences of charging characteristics in polarity, if the pulse width is differed suitably in accordance with the writing voltage polarity.

Further, a method of driving an image display in accordance with the present invention, in the arrangement, may be arranged so that a maximum amplitude of a voltage written to the pixel electrodes is not less than 80% and not more than 98% of an amplitude of a voltage supplied to the signal line.

According to the arrangement, a poor efficiency area where the pixel voltage increases only by negligible amounts compared to the charge time can be chopped off. Therefore, the linearity of charging characteristics, in addition to the effects of the aforementioned arrangement, can be improved.

Further, a method of driving an image display in accordance with the present invention, in the arrangement, may be arranged so that a voltage supplied to the signal line has two values, and tones are displayed by means of pulse widths of the voltages; and the voltage supplied to the scan line is changed in amplitude in the positive polarity writing and in the negative polarity writing.

Image displays to which the drive method is applicable include TFT-LCDs. According to the arrangement, the amplitude on the scan line is changed in positive polarity writing and in negative polarity writing, and differences in write performance can be reduced. Thus, using TFTs, which are three terminal elements, writing initial states of transistor on-resistances can still be aligned, and good tone reproducibility can be achieved.

Further, a driving device for an image display in accordance with the present invention, in the arrangement, may be arranged so that an attained ratio of a maximum value of a voltage written to the pixel electrodes to a voltage supplied to the signal line differs in the positive polarity writing and the negative polarity writing.

As a result, if the attained ratio is suitably differed in accordance with the polarity of the writing voltage similarly to the aforementioned method of driving an image display, the charging characteristics can be made gradual both in the positive and negative directions and a time control width in a tone display can be increased, thus obtaining a stable display state. Namely, it is possible to provide a panel with improved stability against signal delays or non-uniformity in transistor characteristics.

Further, a driving device for an image display in accordance with the present invention, in the arrangement, may be arranged so that a pulse width of a voltage supplied to the signal line in a conduction period of the pixel switching elements for a display of an identical tone differs in the positive polarity writing and the negative polarity writing.

As a result, if the pulse width is suitably differed in accordance with the polarity of the writing voltage similarly to the aforementioned method of driving an image display, desired charge voltages are obtainable regardless of the differences of charging characteristics.

Further, a driving device for an image display in accordance with the present invention, in the arrangement, may be arranged so that a maximum amplitude of a voltage written to the pixel electrodes is not less than 80% and not more than 98% of an amplitude of a voltage supplied to the signal line.

Therefore, the linearity of charging characteristics can be improved by chopping off a poor efficiency area where the pixel voltage increases only by negligible amounts compared to the charge time, similarly to the aforementioned method of driving an image display.

Further, a driving device for an image display in accordance with the present invention, in the arrangement, may be arranged so that a voltage supplied to the signal line has two values, and tones are displayed by means of pulse widths of the voltages; and the voltage supplied to the scan line is changed in amplitude in the positive polarity writing and in the negative polarity writing.

Therefore, differences in write performance can be reduced by changing the amplitude on the scan line voltage between positive polarity writing and negative polarity writing similarly to the aforementioned method of driving an image display. Thus, using TFTs, which are three terminal elements, writing initial states of transistor on-resistances can still be aligned, and good tone reproducibility can be achieved.

The embodiments and examples described in DESCRIPTION OF THE EMBODIMENTS are for illustrative purposes only and by no means limit the scope of the present invention. Variations are not to be regarded as a departure from the spirit and scope of the invention, and all such modifications as would be obvious to one skilled in the art are intended to be included within the scope of the claims below.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A method of driving an image display, comprising the steps of:

applying a scan line voltage to scan lines so as to switch, between on state and off state, pixel switching elements connected to pixel electrodes each provided for a different pixel on a substrate, applying a signal line voltage to signal lines connected to the pixel electrodes through the pixel switching elements when the pixel switching elements are in the on state, applying a common voltage to a common electrode sandwiching the pixels between the same and the pixel electrodes, and while AC driving the pixels, adjusting a pulse width of the signal line voltage for the AC driving when the pixel switching elements are in the on state, so as to control display tones; and causing the scan line voltage and the signal line voltage to differ from each other equally during a specified period of positive polarity pixel writing when the pixel switching elements are in the on-state and during a corresponding period of negative polarity pixel writing when the pixel switching elements are in the on-state.

2. The method of driving an image display as set forth in claim 1, wherein the scan line voltage differs when the voltage it represents on state in positive polarity writing and when it represents on state in negative polarity writing, so that the scan line voltage and the signal line voltage differ from each other equally in positive polarity writing and negative polarity writing of the AC driving.

3. The method of driving an image display as set forth in claim 1, wherein the signal line voltage is changed to charge those of the pixels which are connected to the on-state pixel switching elements, after the signal line voltage and the common voltage are made equal to each other to discharge those pixels.

4. The method of driving an image display as set forth in claim 3, wherein the signal line voltage and the common voltage are changed simultaneously while the signal line voltage and the common voltage are being made equal to each other to discharge those of the pixels which are connected to the on-state pixel switching elements.

5. The method of driving an image display as set forth in claim 1, wherein an attained ratio of a maximum value of a voltage written to the pixel electrodes to a voltage supplied to the signal lines differs in the positive polarity writing and the negative polarity writing.

6. The method of driving an image display as set forth in claim 1, wherein a pulse width of a voltage supplied to the signal lines in a conduction period of the pixel switching elements for a display of an identical tone differs in the positive polarity writing and the negative polarity writing.

7. The method of driving an image display as set forth in claim 1, wherein a maximum amplitude of a voltage written to the pixel electrodes is not less than 80% and not more than 98% of an amplitude of a voltage supplied to the signal lines.

8. A driving device for an image display, comprising:

pixel electrodes each provided for a different pixel on a substrate;

scan lines which apply a scan line voltage to pixel switching elements connected to the pixel electrodes so as to switch the pixel switching elements between on state and off state;

signal lines which apply a signal line voltage to the pixel electrodes through the pixel switching elements; and common electrodes which apply a common voltage to the pixels sandwiched between the same and the pixel electrodes, wherein:

while the pixels are being AC driven, a pulse width of the signal line voltage for the AC driving when the pixel switching elements are in the on state is adjusted, so as to control a voltage written to the pixels for a display of tones; and the scan line voltage and the signal line voltage are caused to differ from each other equally during a specified period of positive polarity pixel writing when the pixel switching elements are in the on-state and during a corresponding period of negative polarity pixel writing when the pixel switching elements are in the on-state.

9. The driving device for an image display as set forth in claim 8, wherein an attained ratio of a maximum value of a voltage written to the pixel electrodes to a voltage supplied to the signal lines differs in the positive polarity writing and the negative polarity writing.

10. The driving device for an image display as set forth in claim 8, wherein a pulse width of a voltage supplied to the signal lines in a conduction period of the pixel switching elements for a display of an identical tone differs in the positive polarity writing and the negative polarity writing.

11. The driving device for an image display as set forth in claim 8, wherein a maximum amplitude of a voltage written to the pixel electrodes is not less than 80% and not more than 98% of an amplitude of a voltage supplied to the signal lines.

12. The driving device for an image display as set forth in claim 8, wherein a voltage supplied to the signal lines has two values, and tones are displayed by means of pulse widths of the voltages; and the voltage supplied to the scan lines is changed in amplitude in the positive polarity writing and in the negative polarity writing.

13. An image display, comprising pixel electrodes each provided for a different pixel on a substrate;

scan lines which apply a scan line voltage to pixel switching elements connected to the pixel electrodes so as to switch the pixel switching elements between on state and off state;

signal lines which apply a signal line voltage to the pixel electrodes through the pixel switching elements;

common electrodes which apply a common voltage to the pixels sandwiched between the same and the pixel electrodes; and a voltage driving section which supplies the scan line voltage to the scan lines, the signal line voltage to the signal lines, and the common voltage to the common electrodes, wherein:

the voltage driving section, while AC driving the pixels, adjusts a pulse width of the signal line voltage for the AC driving when the pixel switching elements are in the on state so as to control a voltage written to the pixels for a display of tones; and the scan line voltage and the signal line voltage are caused to differ from each other equally during a specified period of positive polarity pixel writing when the pixel switching elements are in the on-state and during a corresponding period of negative polarity pixel writing when the pixel switching elements are in the on-state.

14. An image display device comprising:

scan lines and signal lines;

pixels, each of which comprises a pixel switching element and a pixel electrode, the pixel switching element being coupled between one of the signal lines and the pixel electrode, and the pixel switching element including a control terminal connected to one of the scan lines;

a common electrode arrangement provided in a spaced-apart relationship to the pixel electrodes of the pixels;

an AC driving section for respectively applying signals to the scan lines, the signal lines and the common electrode arrangement, wherein the AC driving section varies phase shifts between the signals applied to the signal lines and the signals applied to the scan lines or to the common electrode arrangement to change tones of the pixels, and wherein the AC driving section applies signals to the scan lines and signal lines for positive and negative polarity pixel writing such that a difference between a scan line voltage and a signal line voltage during a specified period of the positive polarity pixel writing when the pixel switching elements are in an on-state is the same as a difference between a scan line voltage and a signal line voltage during a corresponding period of the negative polarity pixel writing when the pixel switching elements are in the on-state.

15. The image display device as set forth in claim 14, wherein the scan line voltage for the positive polarity pixel writing is different than the scan line voltage for the negative polarity pixel writing and the signal line voltage for the positive polarity pixel writing is different than the signal line voltage for the negative polarity pixel writing.

16. The image display device as set forth in claim 14, wherein the signals applied to the common electrode arrangement comprise AC signals.

17. The image display device as set forth in claim 14, wherein the signals applied to the common electrode arrangement comprise DC signals.

18. The image display device as set forth in claim 14, wherein the AC driving section applies signals to the scan lines, the signal lines and the common electrode arrangement such that a signal line voltage and a common electrode voltage associated with a particular pixel are equal to each other for at least some of the time that the pixel switching element for the particular pixel is switched on in a given selection period in accordance with a signal applied to the scan line to which the pixel switching element for the particular pixel is coupled.

19. The image display device as set forth in claim 14, wherein the AC driving section applies signals to the scan lines, the signal lines and the common electrode arrangement such that a signal line voltage and a common electrode voltage associated with a particular pixel are changed simultaneously while maintaining a specified difference therebetween during the time that the pixel switching element for the particular pixel is switched on in a given selection period in accordance with a signal applied to the scan line to which the pixel switching element for the particular pixel is coupled.

20. The image display device as set forth in claim 14, wherein the AC driving section applies signals to the scan lines, the signal lines and the common electrode arrangement such that a signal line voltage and a common electrode voltage associated with a particular pixel are equal to each other for at least some of the time that the pixel switching element for the particular pixel is switched on in a given selection period in accordance with a signal applied to the scan line to which the pixel switching element for the particular pixel is coupled, and, thereafter, in the same given selection period, the signal line voltage is inverted while the common electrode voltage remains the same.

21. The image display device as set forth in claim 14, wherein the AC driving section applies signals to the scan lines, the signal lines and the common electrode arrangement such that the scan line voltage during one or both of the positive and negative polarity pixel writing to a particular pixel changes from a first value to a second value.

22. The image display device as set forth in claim 14, wherein the common electrode arrangement comprises a plurality of common electrodes.

23. A mobile telephone comprising an image display device as set forth in claim 14.

24. A personal digital assistant comprising an image display device as set forth in claim 14.

25. A method of driving an image display, comprising the steps of:

applying a scan line voltage to scan lines so as to switch, between on state and off state, pixel switching elements connected to pixel electrodes each provided for a different pixel on a substrate, applying a signal line voltage to signal lines connected to the pixel electrodes through the pixel switching elements when the pixel switching elements are in the on state, applying a common voltage to a common electrode sandwiching the pixels between the same and the pixel electrodes, and while AC driving the pixels, adjusting a pulse width of the signal line voltage for the AC driving when the pixel switching elements are in the on state, so as to control display tones; and causing the scan line voltage and the signal line voltage to differ from each other equally in positive polarity pixel writing and negative polarity pixel writing of the AC driving, wherein a scan line voltage for use in positive polarity pixel writing and a positive signal line voltage are applied in positive polarity writing and a scan line voltage for use in negative polarity writing is applied in negative polarity writing.

26. The method of driving an image display as set forth in claim 25, wherein the signal line voltage is changed to charge those of the pixels which are connected to the on-state pixel switching elements, after the signal line voltage and the common voltage are made equal to each other to discharge those pixels.

27. The method of driving an image display as set forth in claim 26, wherein the signal line voltage and the common voltage are changed simultaneously while the signal line voltage and the common voltage are being made equal to each other to discharge those of the pixels which are connected to the on-state pixel switching elements.

28. The method of driving an image display as set forth in claim 25, wherein an attained ratio of a maximum value of a voltage written to the pixel electrodes to a voltage supplied to the signal lines differs in the positive polarity writing and the negative polarity writing.

29. The method of driving an image display as set forth in claim 25, wherein a pulse width of a voltage supplied to the signal lines in a conduction period of the pixel switching elements for a display of an identical tone differs in the positive polarity writing and the negative polarity writing.

30. The method of driving an image display as set forth in claim 25, wherein a maximum amplitude of a voltage written to the pixel electrodes is not less than 80% and not more than 98% of an amplitude of a voltage supplied to the signal lines.

31. An image display device comprising:

scan lines and signal lines;

pixels, each of which comprises a pixel switching element and a pixel electrode, the pixel switching element being coupled between one of the signal lines and the pixel electrode, and the pixel switching element including a control terminal connected to one of the scan lines;

a common electrode arrangement provided in a spaced-apart relationship to the pixel electrodes of the pixels;

an AC driving section for respectively applying signals to the scan lines, the signal lines and the common electrode arrangement, wherein the AC driving section varies phase shifts between the signals applied to the signal lines and the signals applied to the scan lines or to the common electrode arrangement to change tones of the pixels, wherein the AC driving section applies signals to the scan lines and signal lines for positive and negative polarity pixel writing such that a difference between a scan line voltage and a signal line voltage for the positive polarity pixel writing is the same as a difference between a scan line voltage and a signal line voltage for the negative polarity pixel writing, and wherein a scan line voltage for use in positive polarity pixel writing and a positive signal line voltage are applied in positive polarity writing and a scan line voltage for use in negative polarity writing is applied in negative polarity writing.

* * * * *